US010807828B2

(12) United States Patent
Perini

(10) Patent No.: US 10,807,828 B2
(45) Date of Patent: Oct. 20, 2020

(54) METHOD FOR HANDLING PARENT REELS IN PAPER CONVERTING PLANTS

(71) Applicant: FUTURA S.P.A., Capannori (LU) (IT)

(72) Inventor: Fabio Perini, Viareggio (IT)

(73) Assignee: FUTURA S.P.A., Capannori (LU) (IT)

( * ) Notice: Subject to any disclaimer, the term of this patent is extended or adjusted under 35 U.S.C. 154(b) by 388 days.

(21) Appl. No.: 15/512,697

(22) PCT Filed: Sep. 17, 2015

(86) PCT No.: PCT/IT2015/000229
§ 371 (c)(1),
(2) Date: Mar. 20, 2017

(87) PCT Pub. No.: WO2016/046852
PCT Pub. Date: Mar. 31, 2016

(65) Prior Publication Data

US 2017/0240378 A1 Aug. 24, 2017

(30) Foreign Application Priority Data

Sep. 23, 2014 (IT) ..... FI2014A0220

(51) Int. Cl.
*B65H 19/12* (2006.01)
*B65H 49/38* (2006.01)
(Continued)

(52) U.S. Cl.
CPC ..... *B65H 49/38* (2013.01); *B65H 16/06* (2013.01); *B65H 19/126* (2013.01);
(Continued)

(58) Field of Classification Search
None
See application file for complete search history.

(56) References Cited

U.S. PATENT DOCUMENTS 3,695,532 A 10/1972 Lindstaedt
4,708,300 A * 11/1987 Goetz ..... B65H 19/126 242/551
8,016,223 B2 * 9/2011 Pienta ..... B65H 19/126 242/559

FOREIGN PATENT DOCUMENTS

EP 0 559 581 A1 9/1993
EP 1601600 B1 2/2010
(Continued)

*Primary Examiner* — Mark C Hageman
(74) *Attorney, Agent, or Firm* — McGlew and Tuttle, P.C.

(57) ABSTRACT

Method for the handling of parent reels in paper converting plants, comprising the following steps: (a) providing at least one platform with a base adapted to support a parent reel in a waiting station and at least one unwinder (S) adapted to receive said reel in an unwinding station where the parent reel is unwound; (b) positioning a parent reel (1) on the platform at the waiting station; (c) transporting the parent reel (1) along a predefined path from said platform to said unwinder (S) by means of a bridge crane (CP) equipped with movable arms (BC). The step (c) is preceded by a first step consisting in the temporary association of two pins (P) to the arms (BC) of the bridge crane (CP) and by a second step consisting in inserting the two pins (P) in two opposite bases of the parent reel (1) using the same arms (BC); and the step (c) involves the transport of the reel (1) along a path comprising at least one ascending or descending portion with the pins (P) thus inserted into the parent reel (1).

18 Claims, 34 Drawing Sheets

(51) Int. Cl.
*B65H 75/24* (2006.01)
*B65H 16/06* (2006.01)

(52) U.S. Cl.
CPC ... *B65H 75/242* (2013.01); *B65H 2301/4137* (2013.01); *B65H 2301/41346* (2013.01); *B65H 2301/41732* (2013.01); *B65H 2515/10* (2013.01)

(56) References Cited

FOREIGN PATENT DOCUMENTS

| | | | |
|---|---|---|---|
| EP | 1742860 | B1 | 8/2011 |
| WO | 03/062107 | A1 | 7/2003 |
| WO | 2009/050332 | A1 | 4/2009 |

* cited by examiner

METHOD FOR HANDLING PARENT REELS IN PAPER CONVERTING PLANTS

The present invention relates to a method for handling parent reels in paper converting plants.

It is known that the production of paper logs implies the feeding of a continuous paper web along a predetermined path. The paper web is transversely perforated at a predetermined point of said path so that it is divided into sheets of predetermined length separable by tearing. Furthermore, use is made of tubular elements (commonly said cores) on whose surface is applied a predetermined amount of glue to allow the glueing of the first sheet of the log to be formed. Moreover, use is made of winding rollers, positioned and acting in logs formation station, that cause the rotation of the core on which the paper is wound. The formation of a log ends when a given amount of paper is wound on the core. Then, another log is formed. When the formation of a log is completed, the last sheet of the log must be glued on the underlying sheet to avoid the spontaneous unwinding of the log. Each log is then subdivided into a plurality of shorter rolls by means of cutting-off machines.

In order to permit the proper running of the process, a paper converting plant always comprises an unwinder where are positioned the parent reels from which the paper web is fed. The unwinders comprise, in particular, base for supporting each parent reel and the latter can rotate about its longitudinal axis since it is attached to two supporting pins, each of which is removably inserted in a corresponding side of the parent reel. When the paper is unwound, the parent reel is on the base of the unwinder and the pins are inside the parent reel, while, generally, when the parent reel is almost exhausted and must be substituted, the pins are extracted to free it. Finally, a paper converting plant normally comprises a bridge crane by means of which the parent reel is moved from a parking position to the unwinder.

The main object of the present invention is to propose a method for handling parent reels that is particularly efficient and, at the same time, safe and featuring a high automation level.

This result is achieved, according to the present invention, by a method having the features indicated in claim 1. Other features of the present invention are the subject of the dependent claims.

A method according to the present invention provides the advantage of making the parent reels transferring steps more safe and efficient, automatable and controllable in a relatively simple and economic way.

These and other advantages and features of this invention will be best understood by anyone skilled in the art thanks to the following description and to the attached drawings, provided by way of example but not to be considered in a limiting sense, in which.

Figure 2:
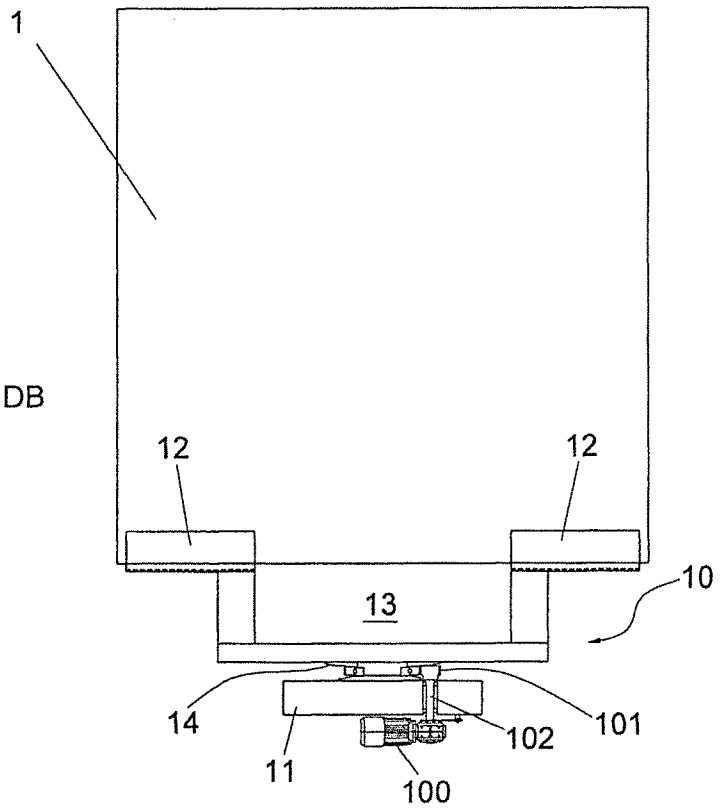
FIG. 2 is a shematic side view of the apparatus shown in FIG. 1.
Figure 1:
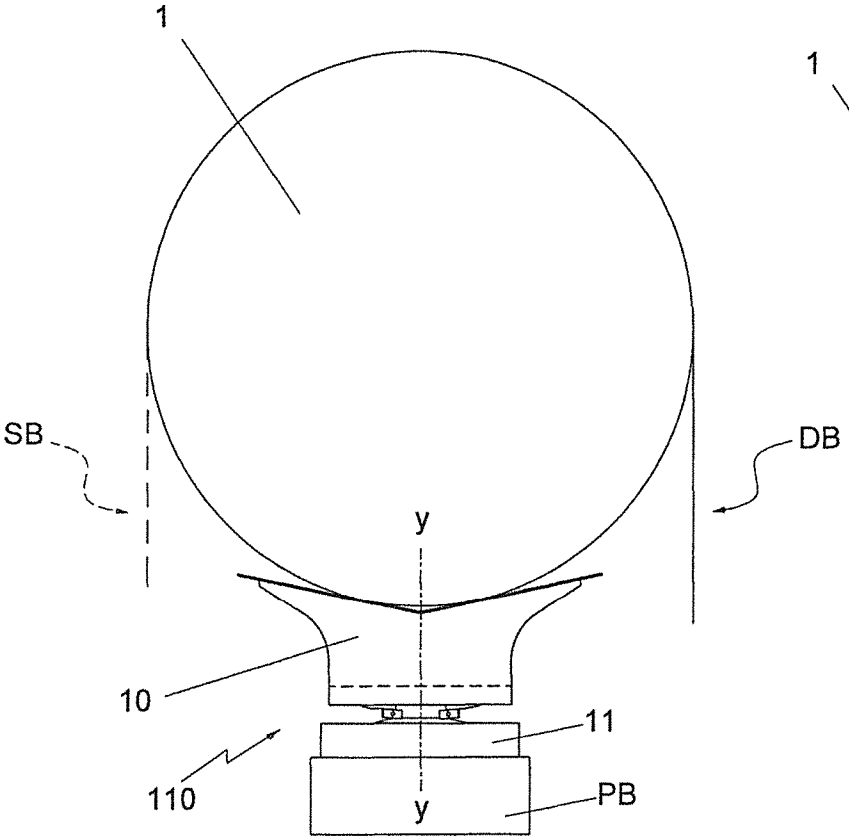
FIG. 1 is a schematic side view of an apparatus for supporting parent reels in a plant adapted to carry out a method according to the present invention with a parent reel on said supporting apparatus.
Figure 5:
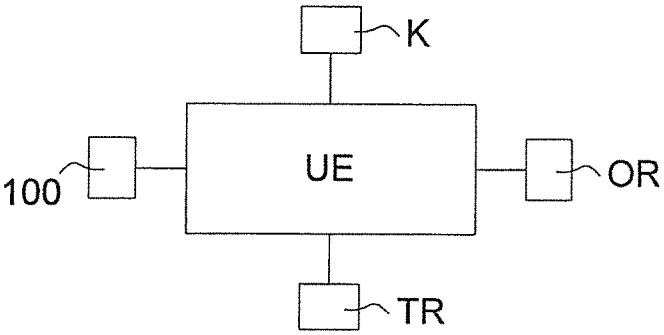
Figure 4:
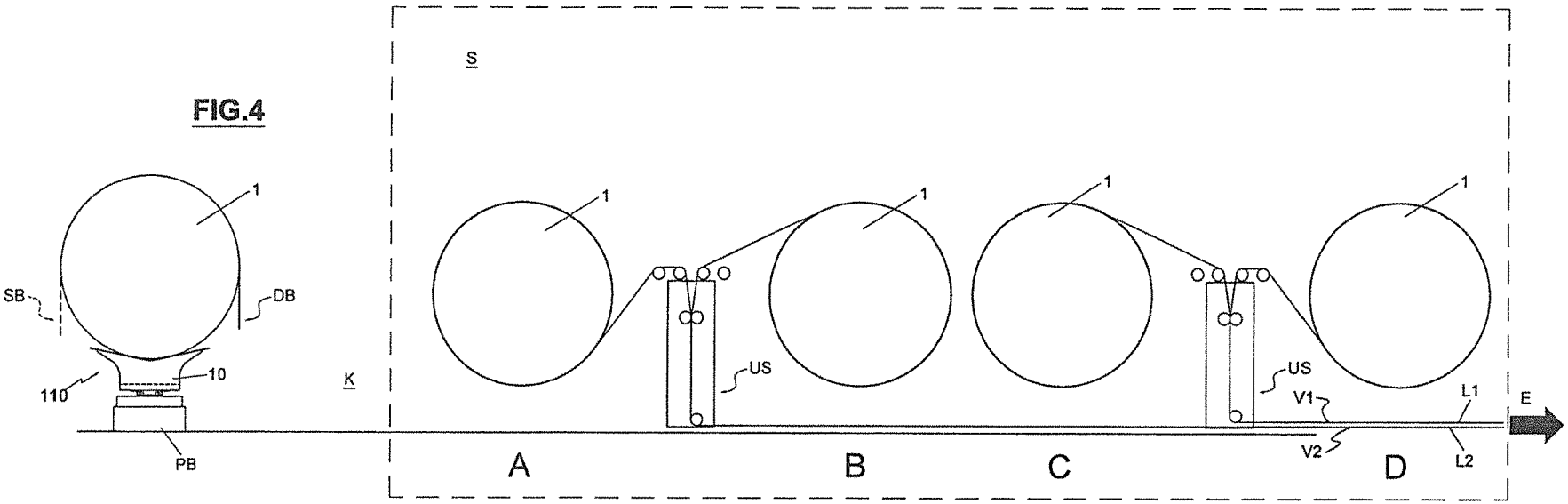
Figure 6:
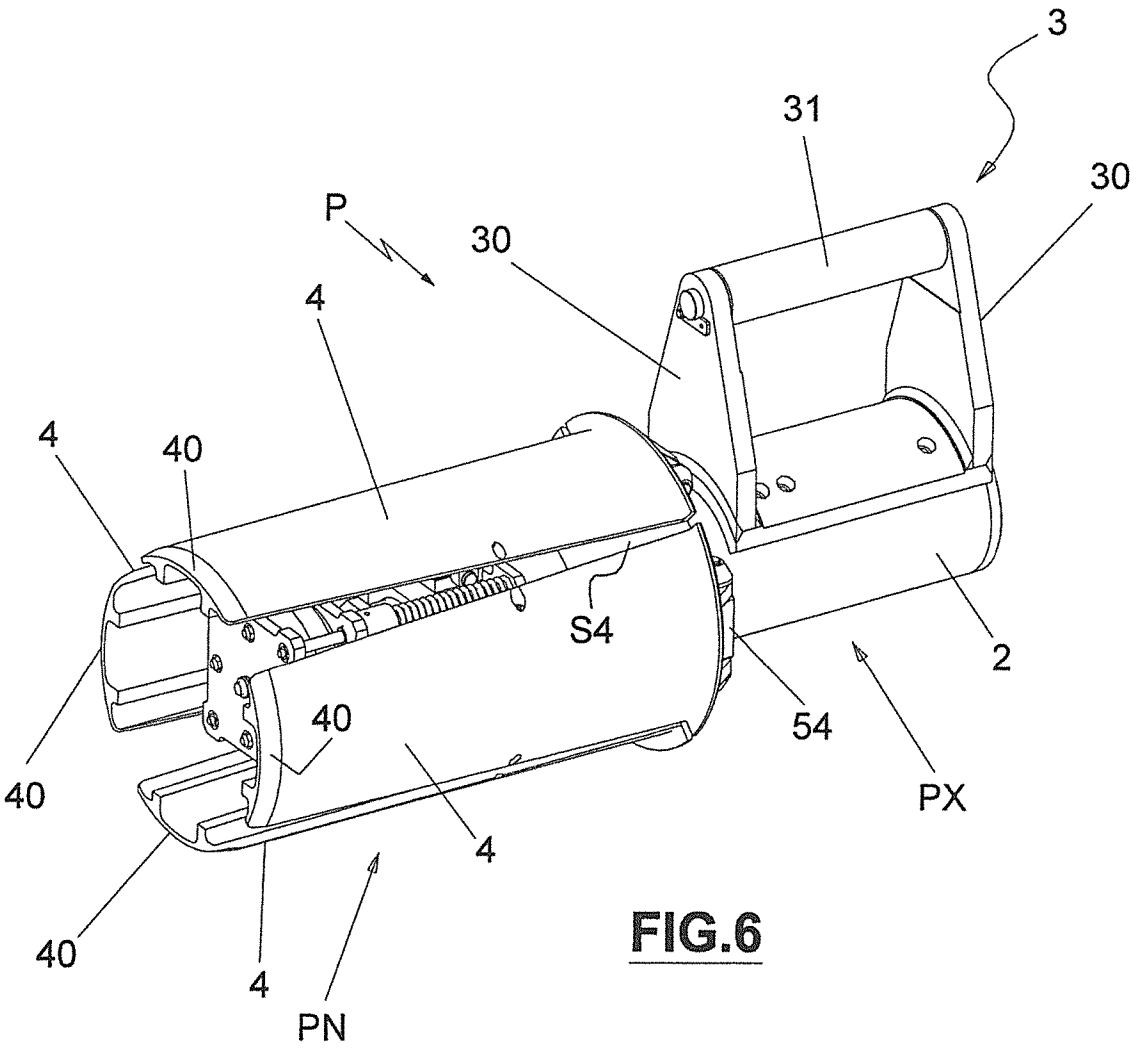
Figure 7:
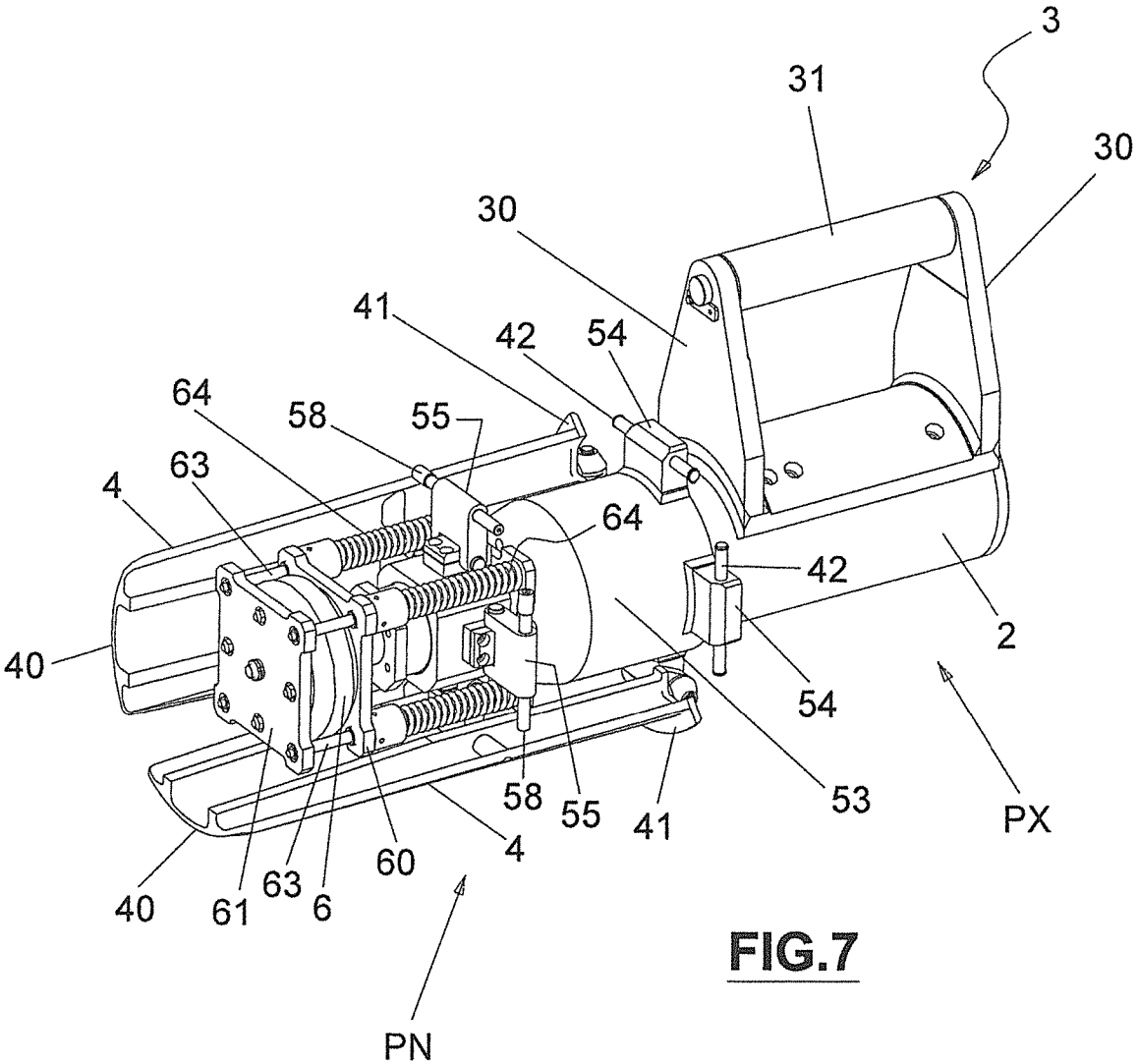
Figure 9B:
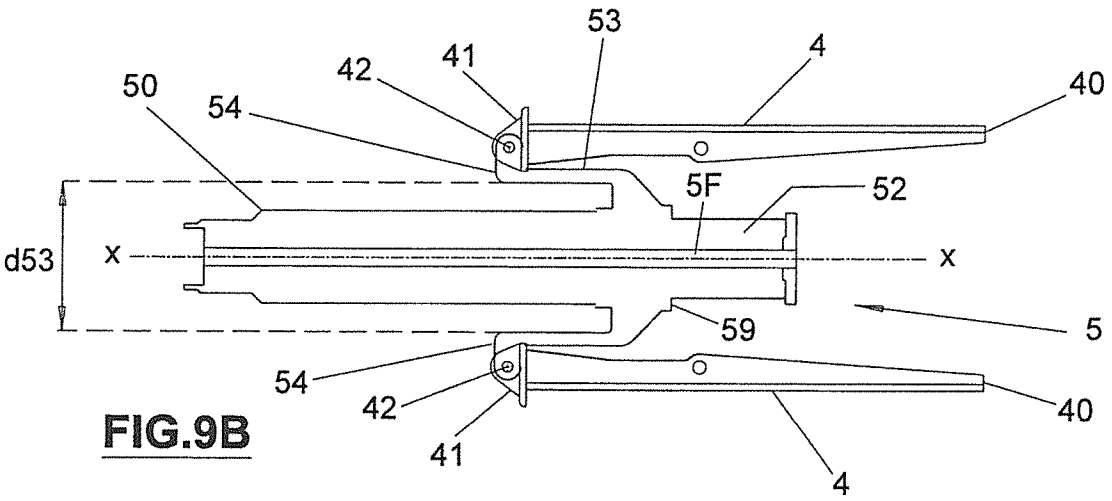
Figure 8:
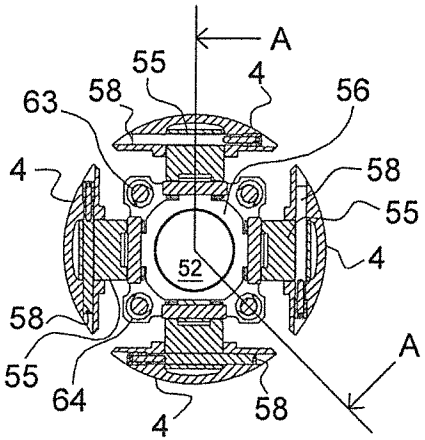
Figure 9A:
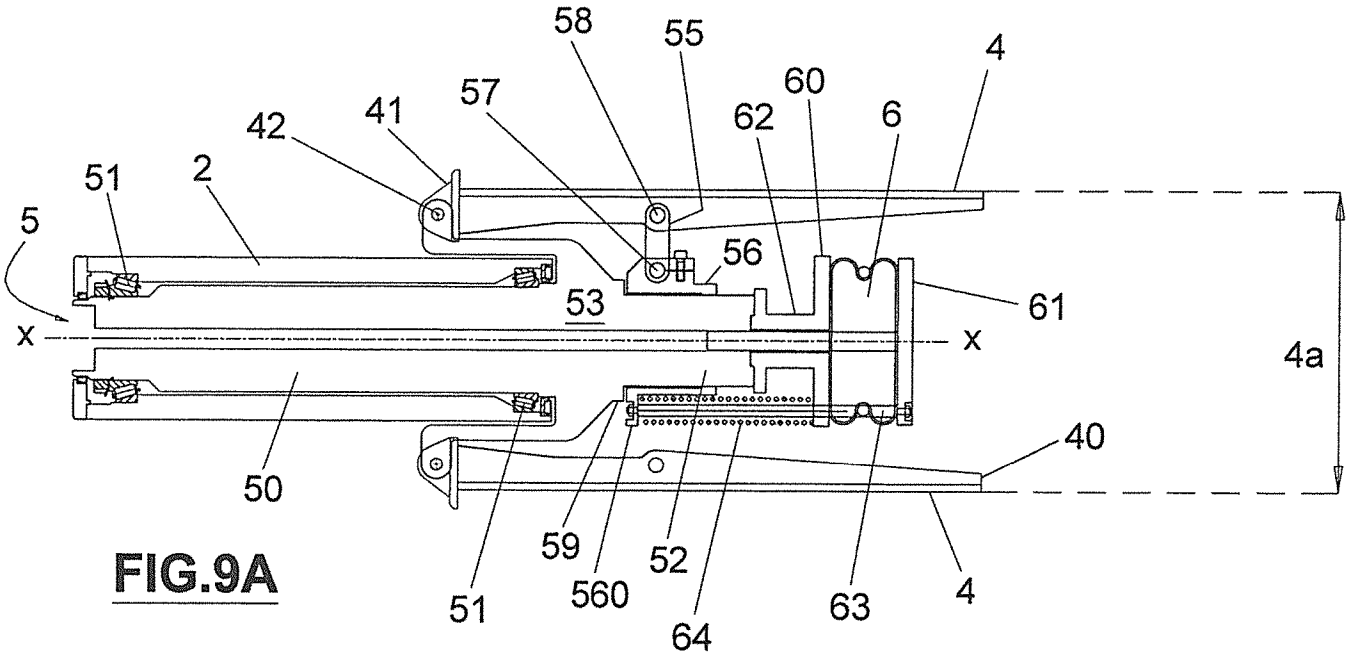
Figure 10:
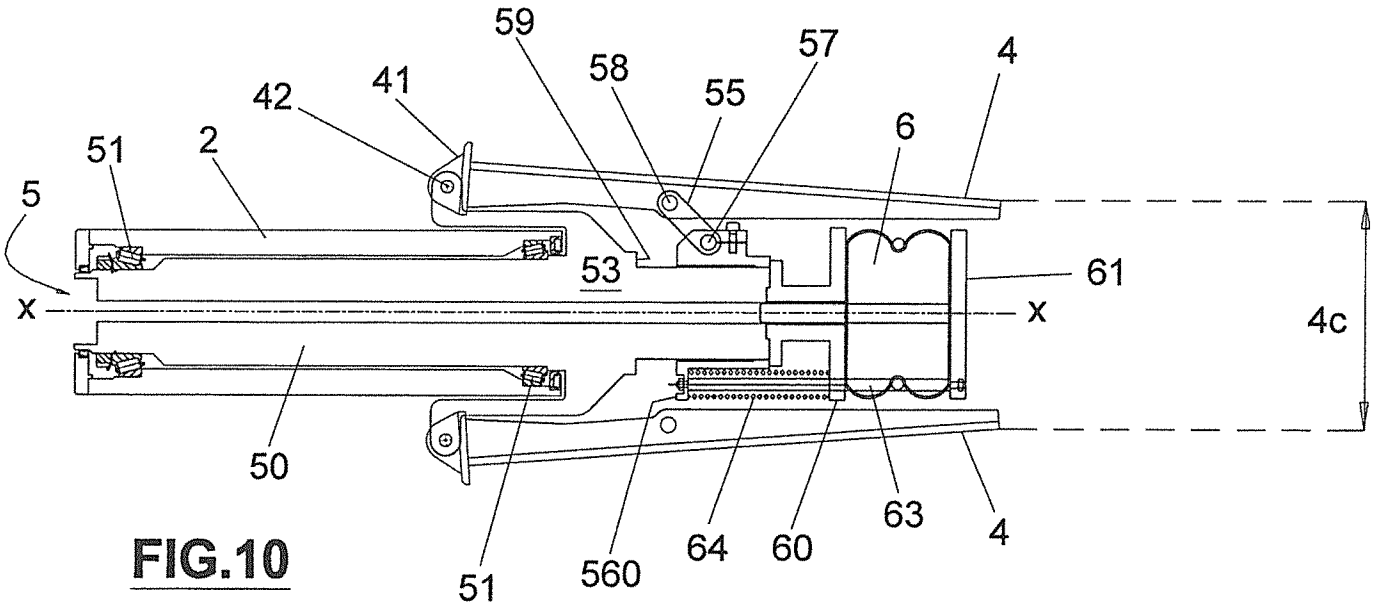
Figure 11:
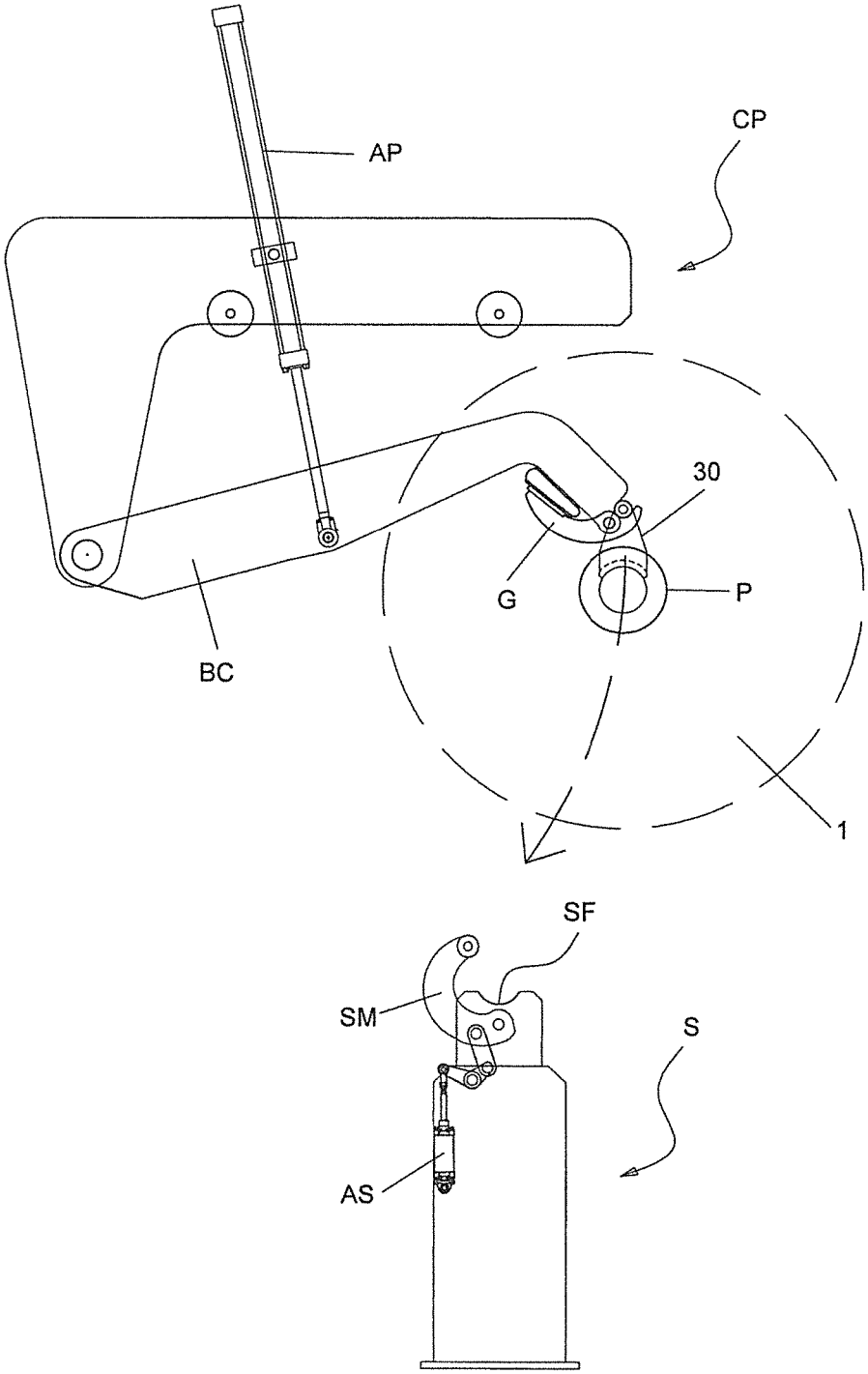
Figure 17:
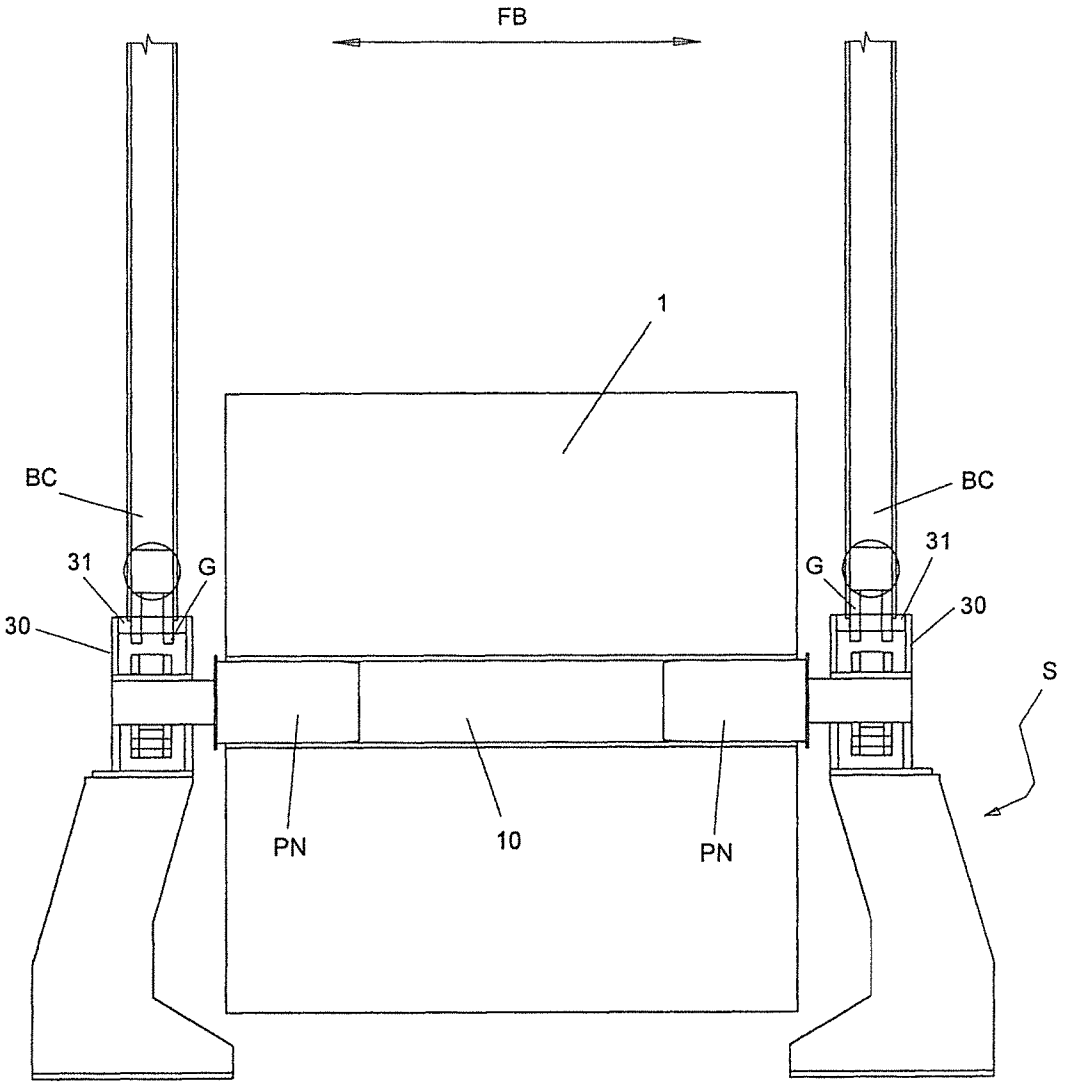
Figure 19:
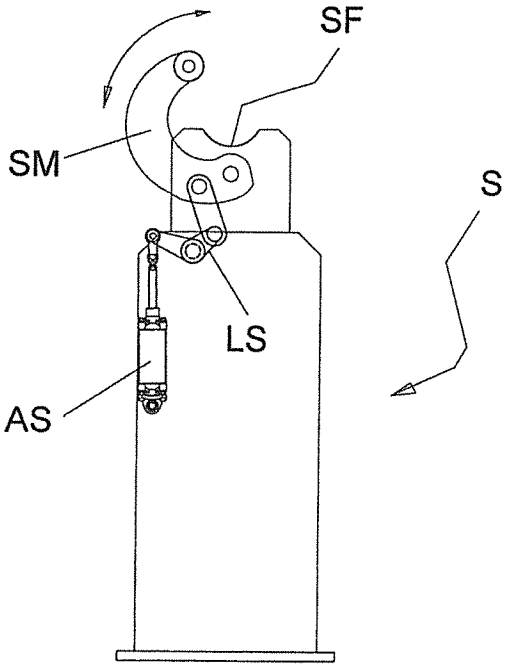
Figure 18:
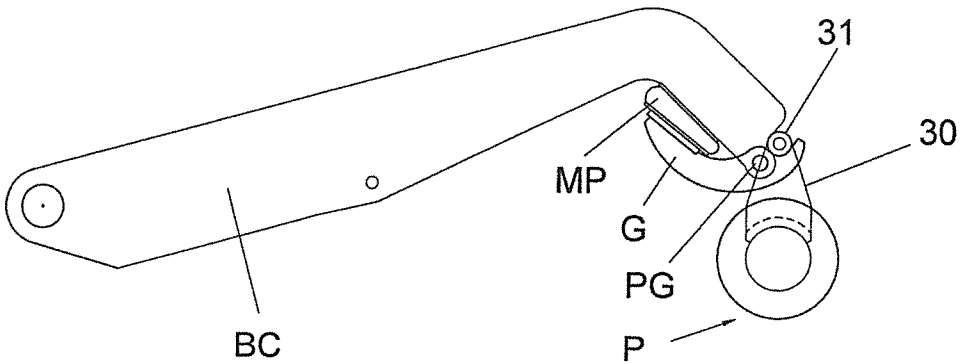
Figure 20:
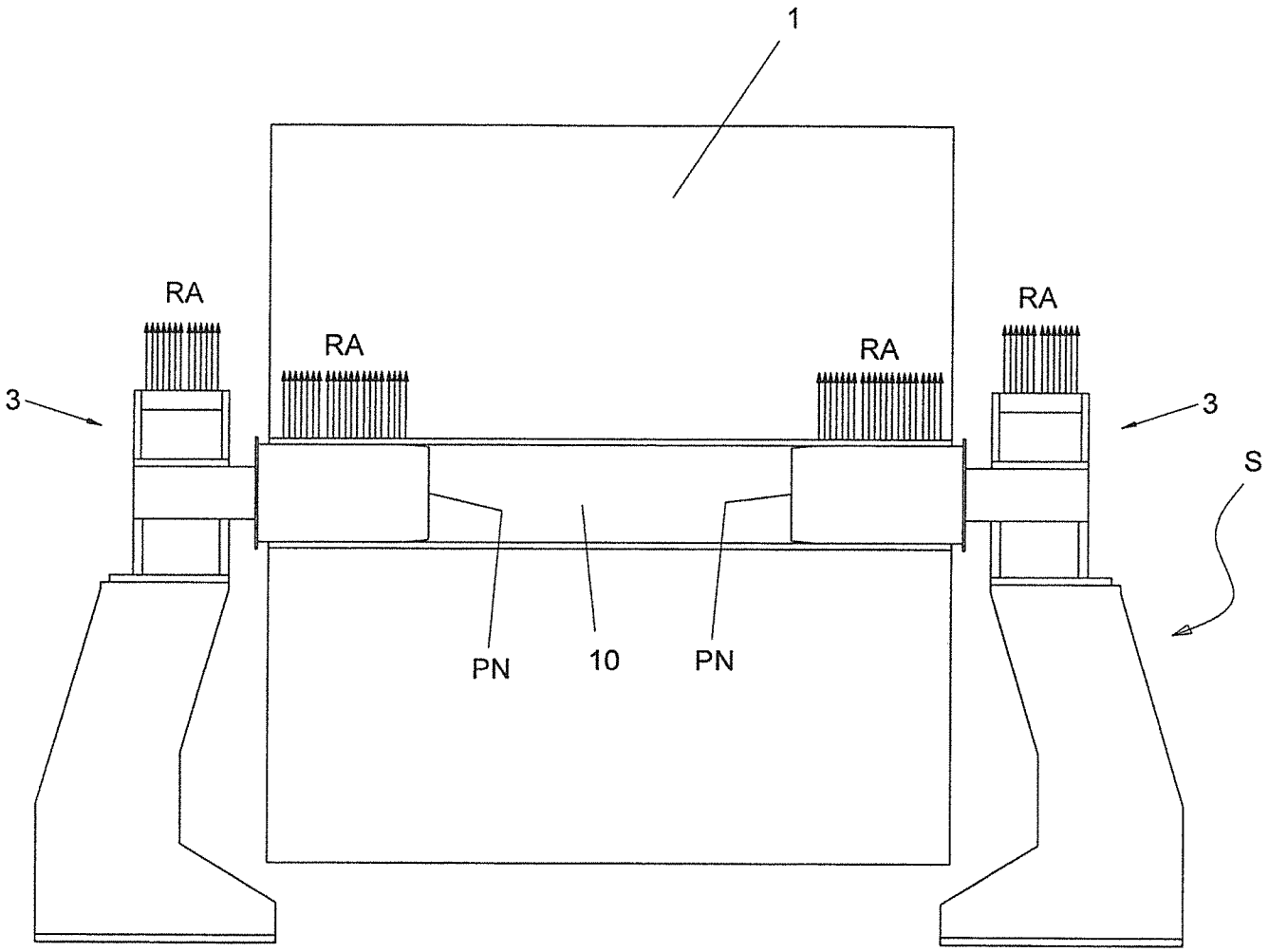
Figure 21:
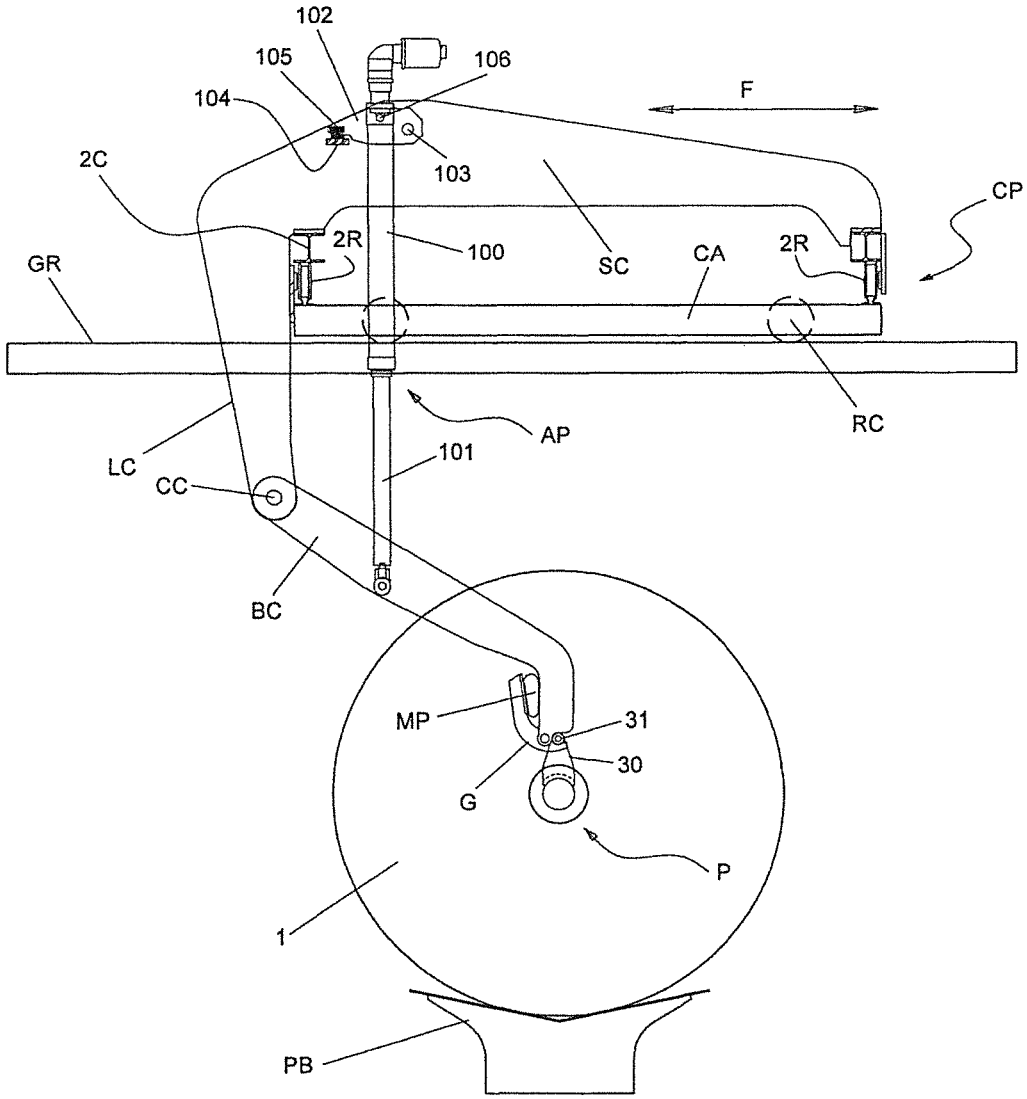
Figure 22A:
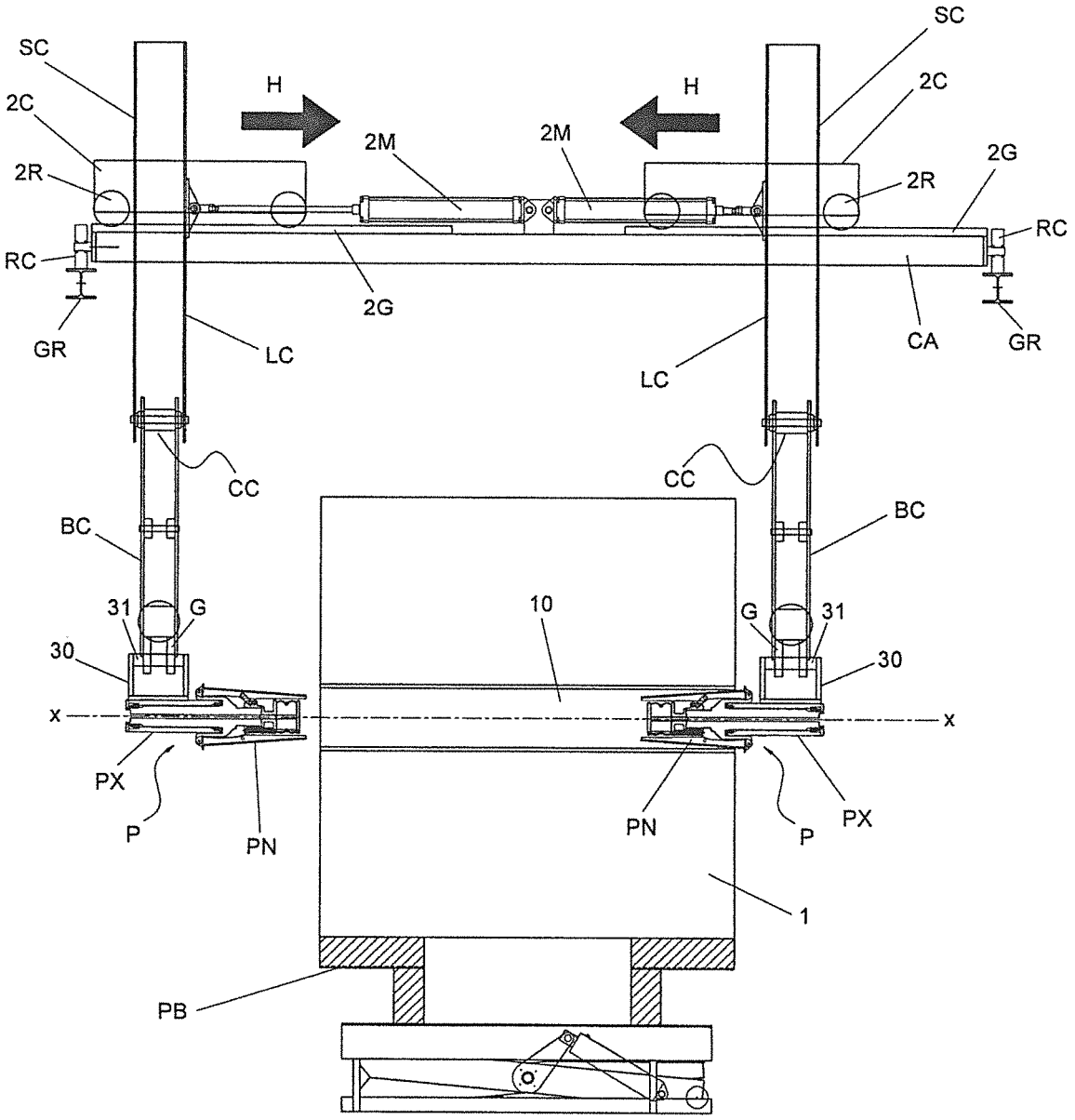
Figure 22B:
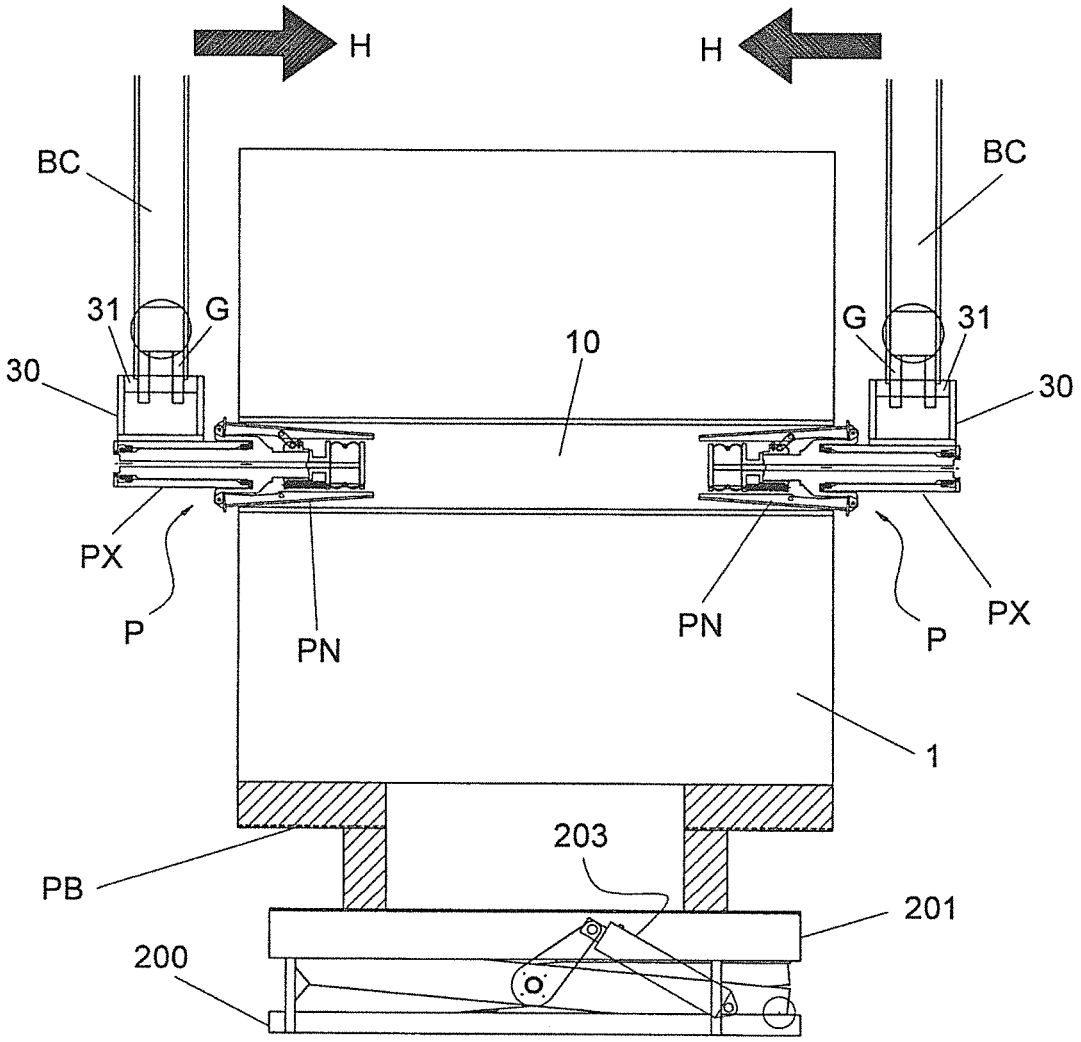
Figure 23:
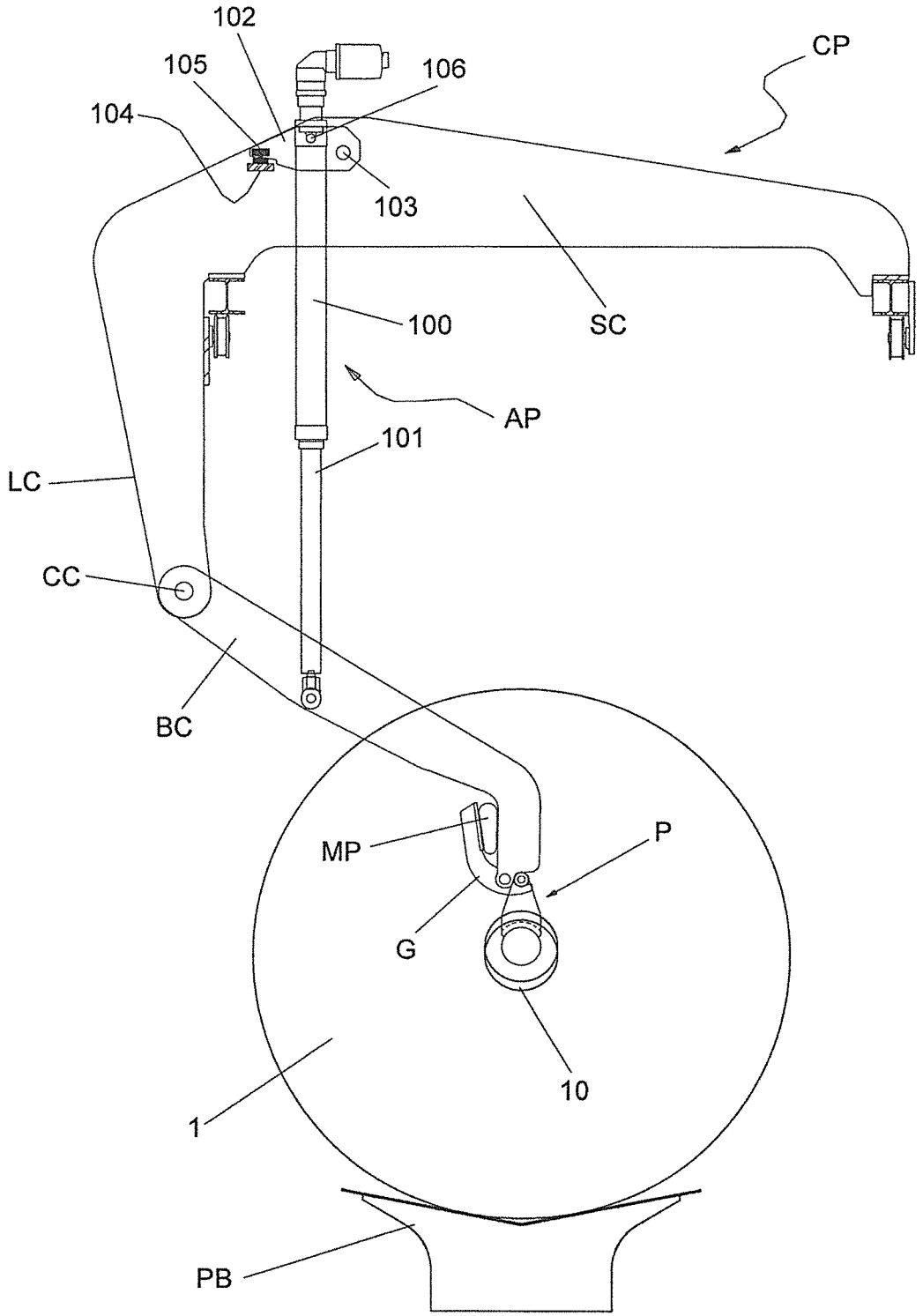
Figure 24:
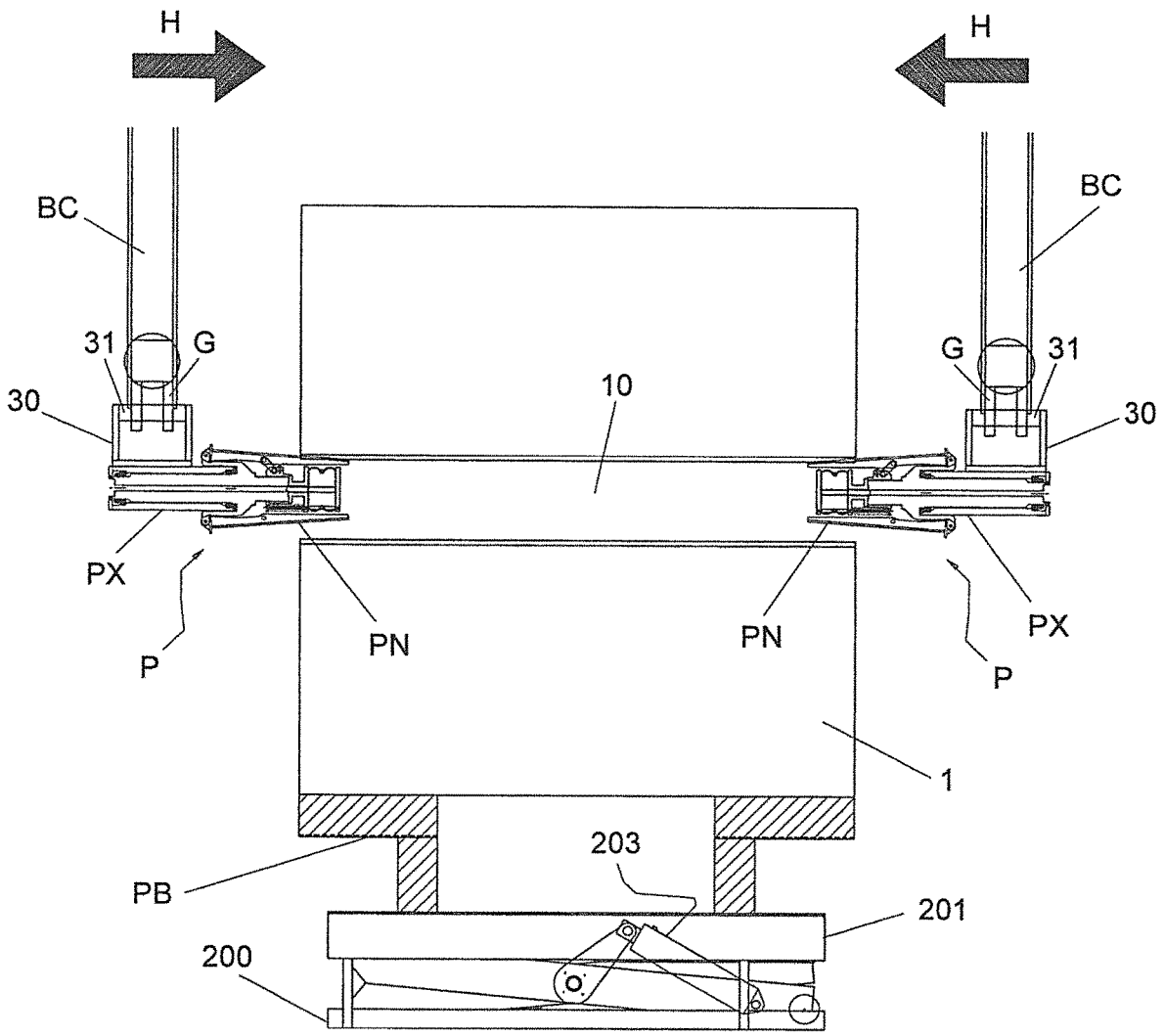
Figure 25:
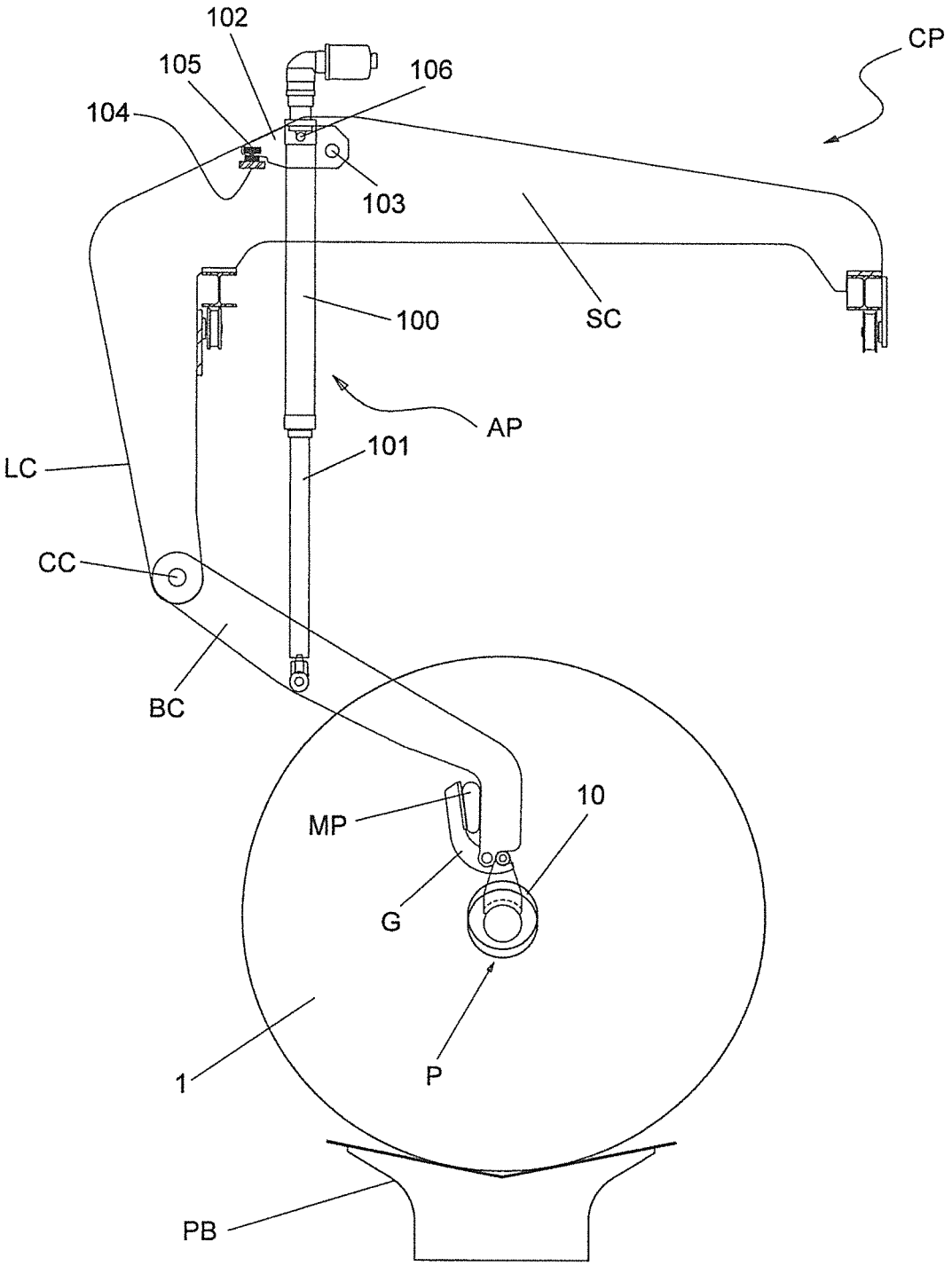
Figure 26:
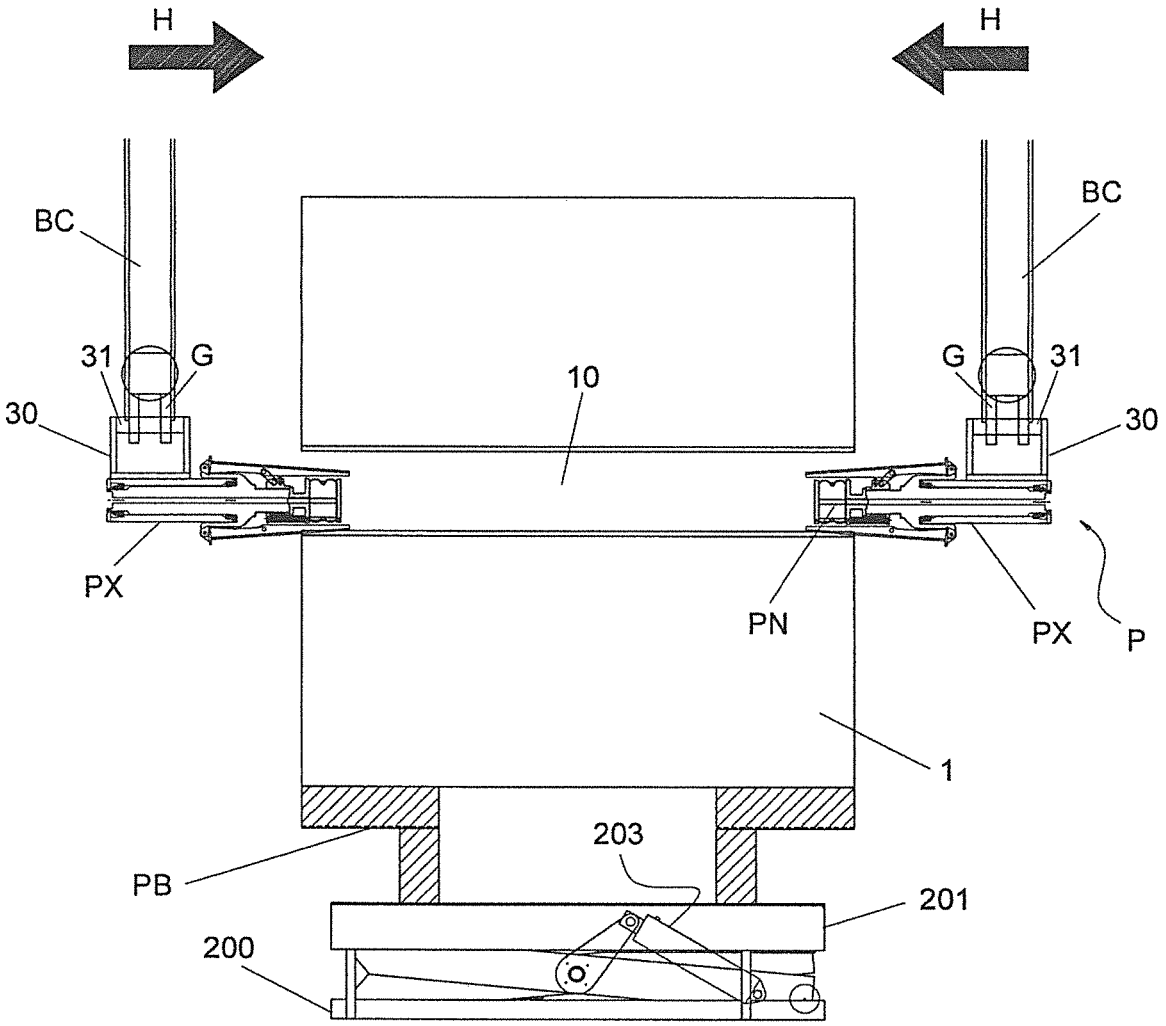
Figure 28:
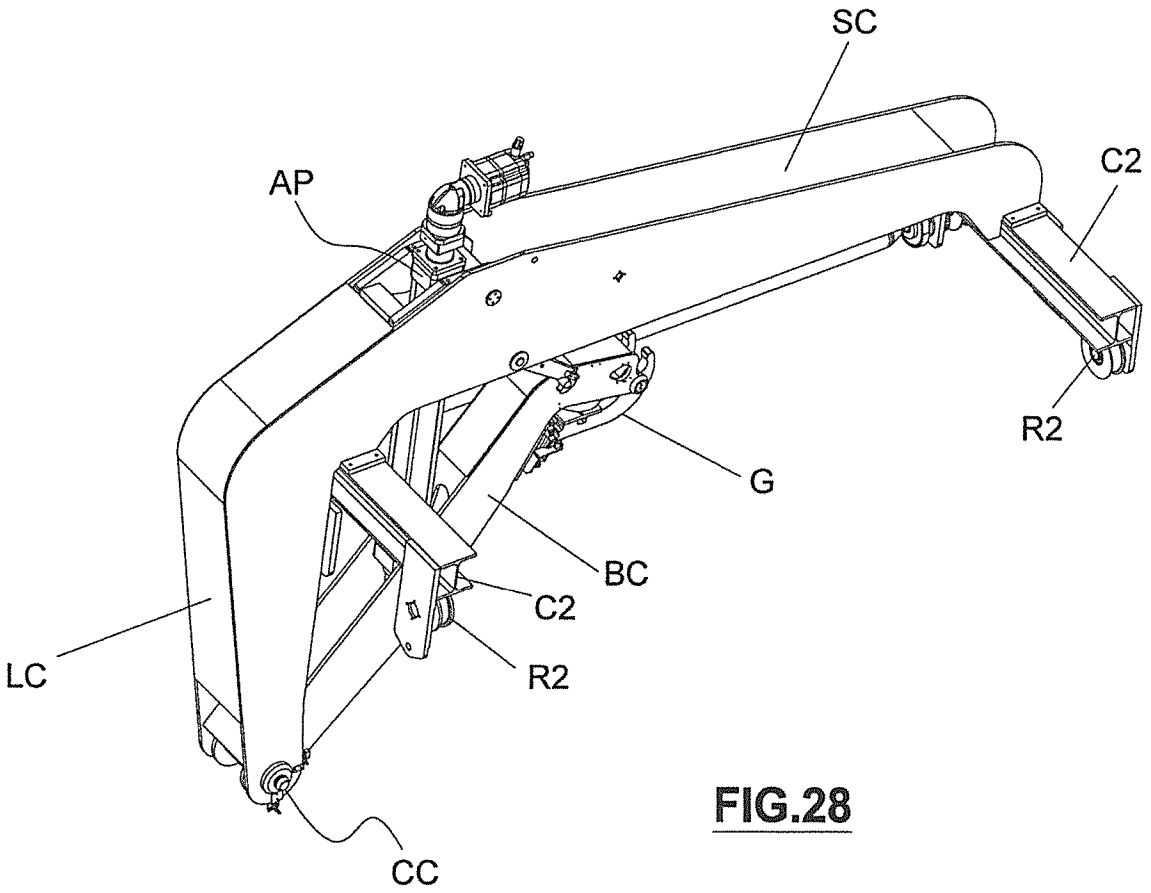
Figure 27:
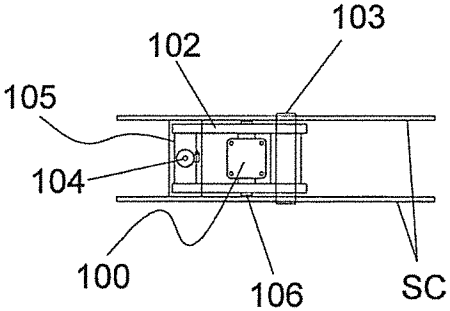
Figure 29A:
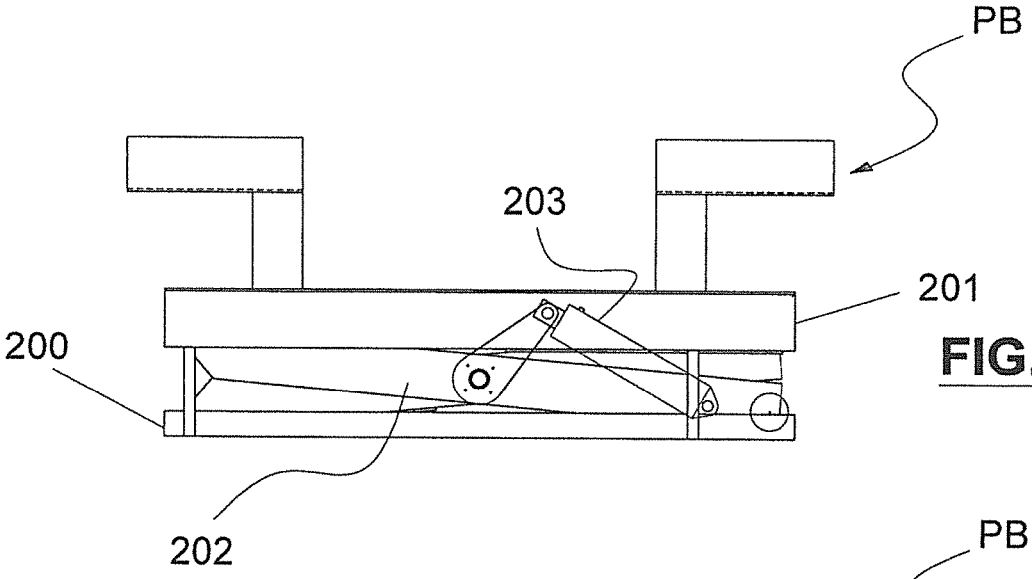
Figure 29B:
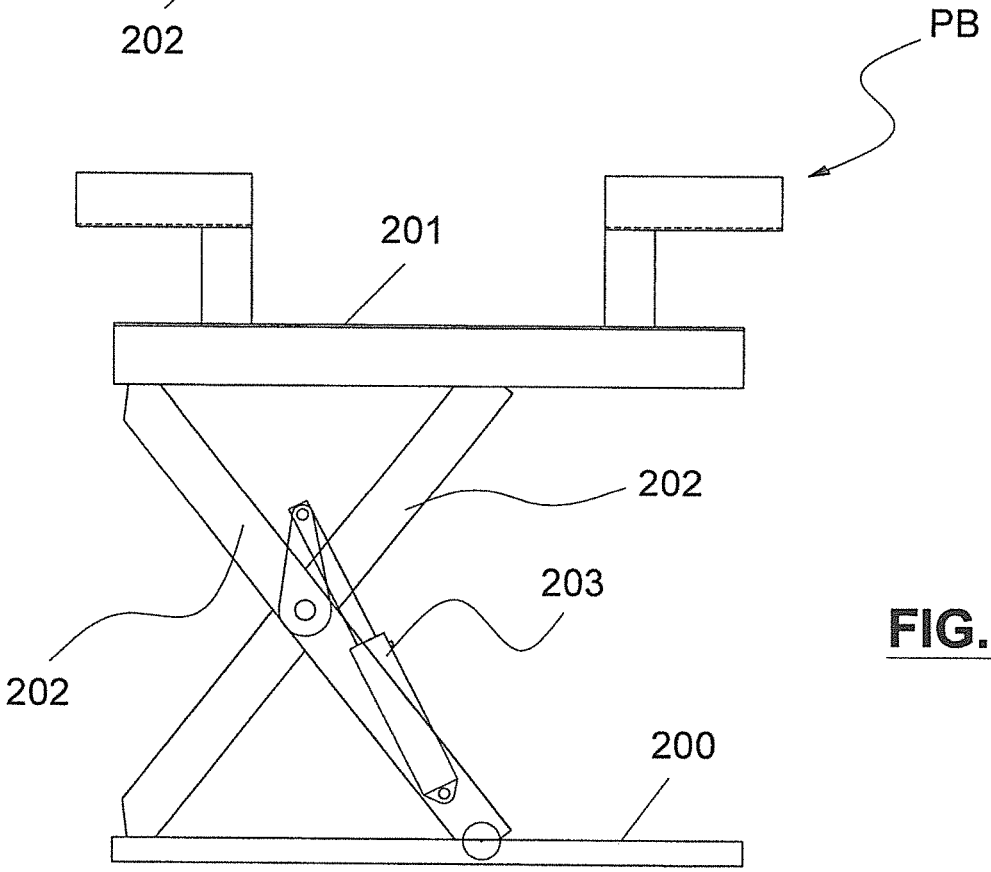
Figure 30B:
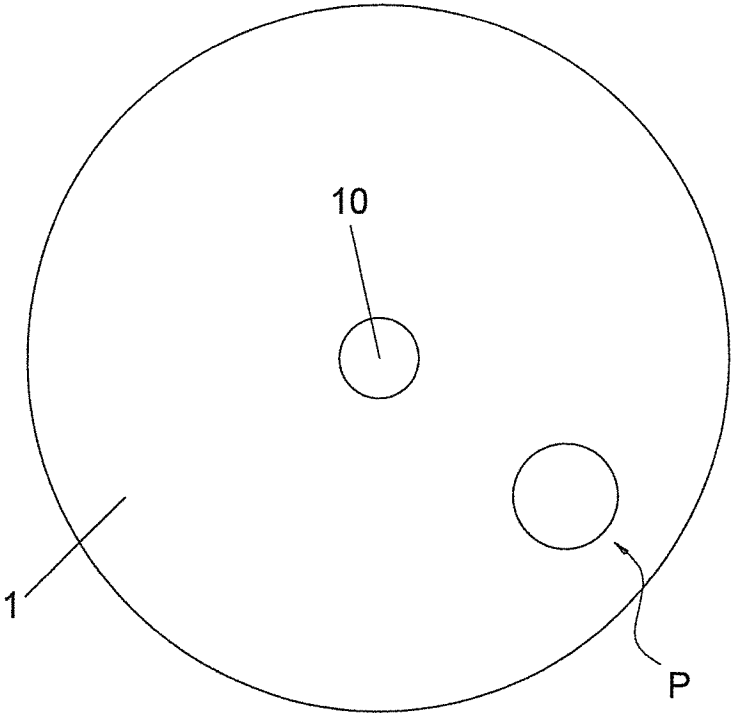
Figure 30:
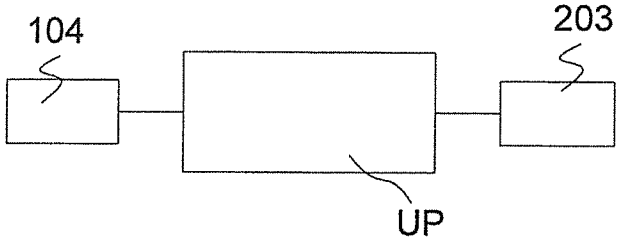
Figure 32:
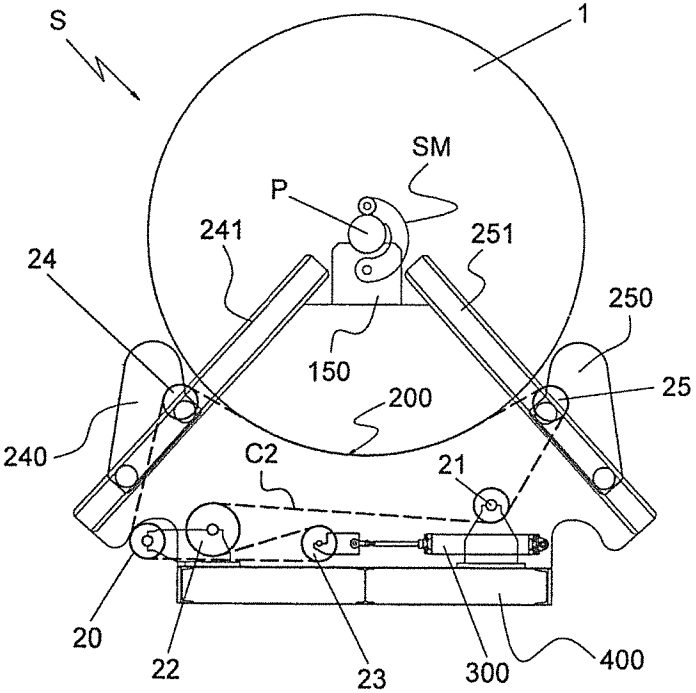
Figure 31:
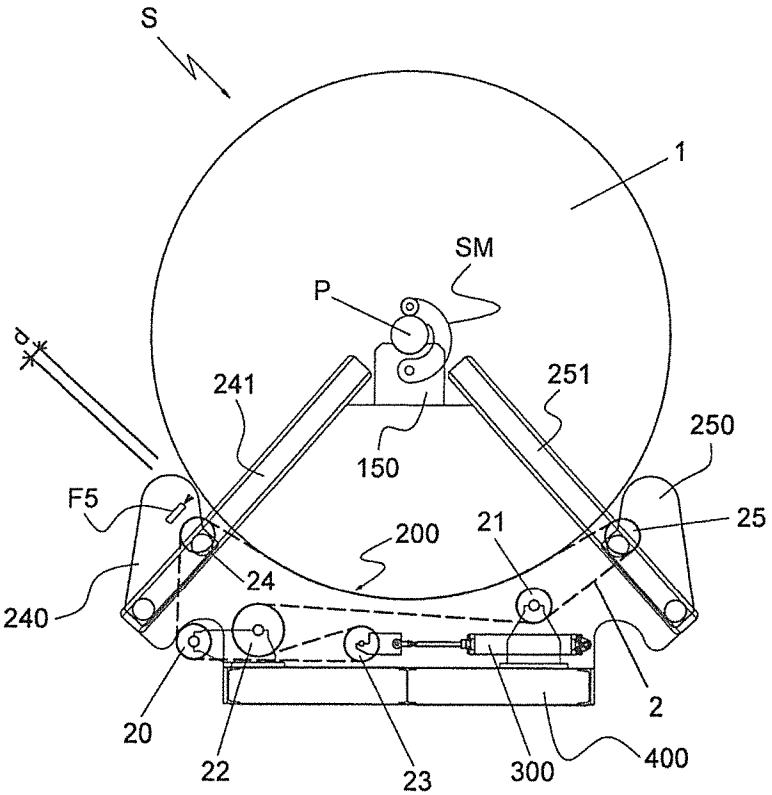
Figure 34:
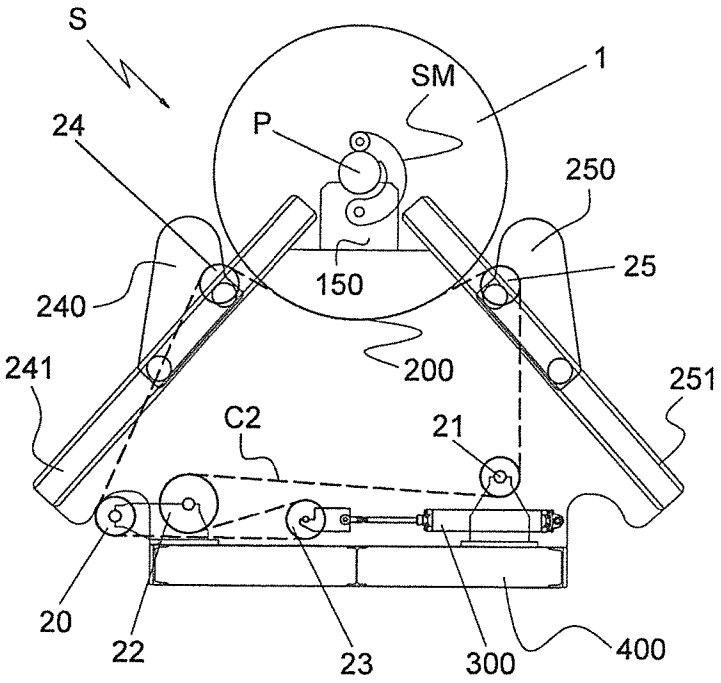
Figure 33:
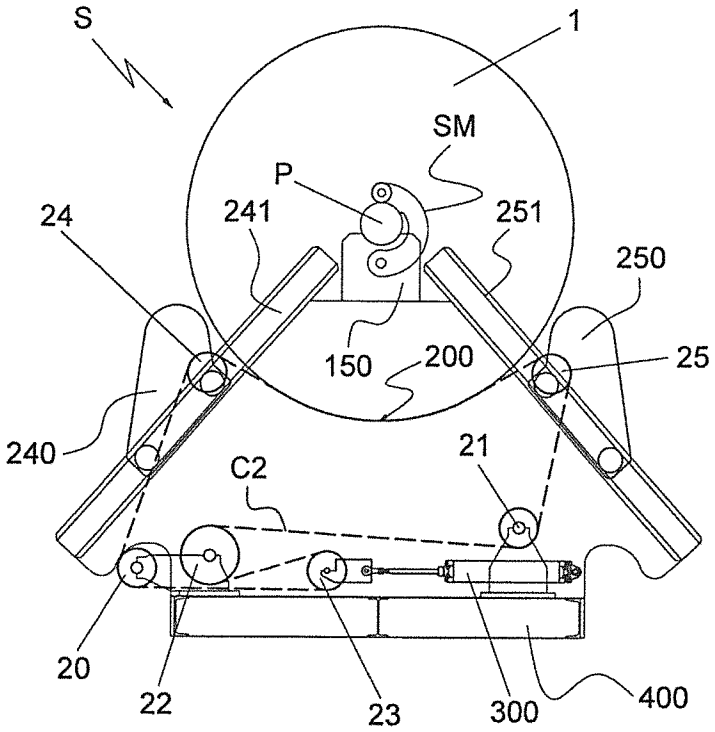
Figure 36:
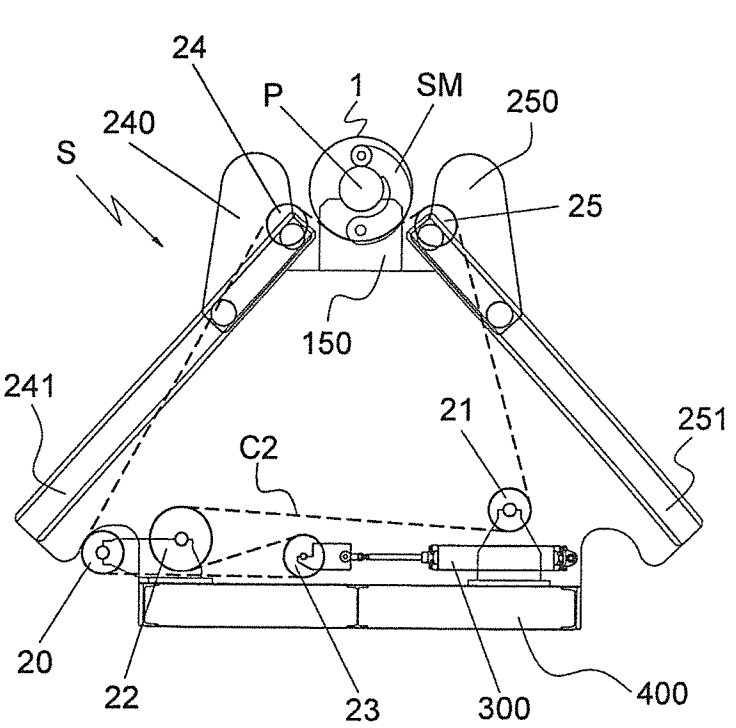
Figure 35:
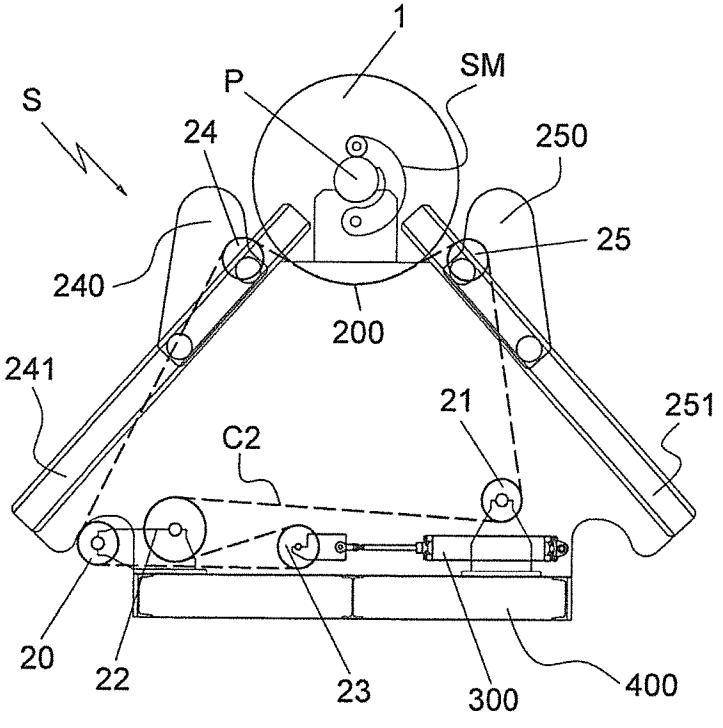
Figure 37:
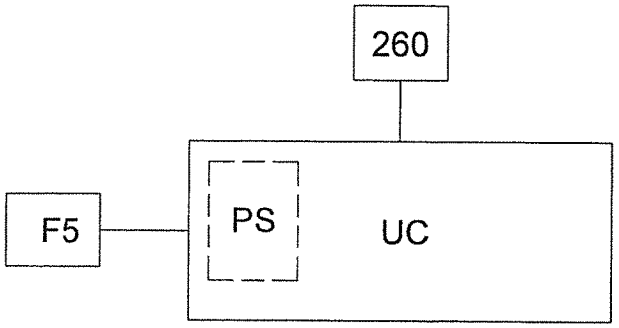
Figure 38:
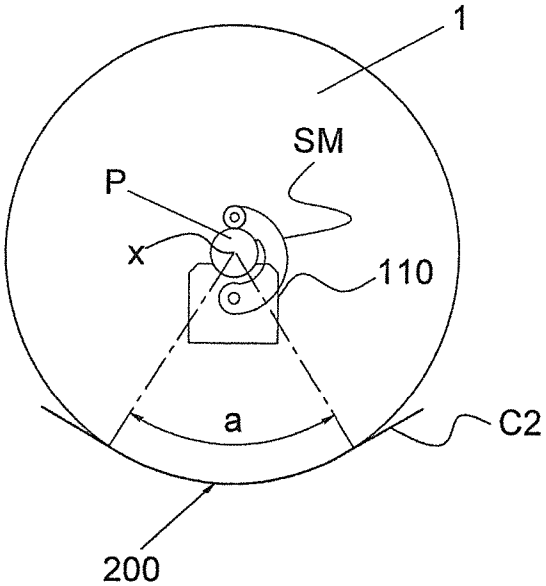
Figure 39:
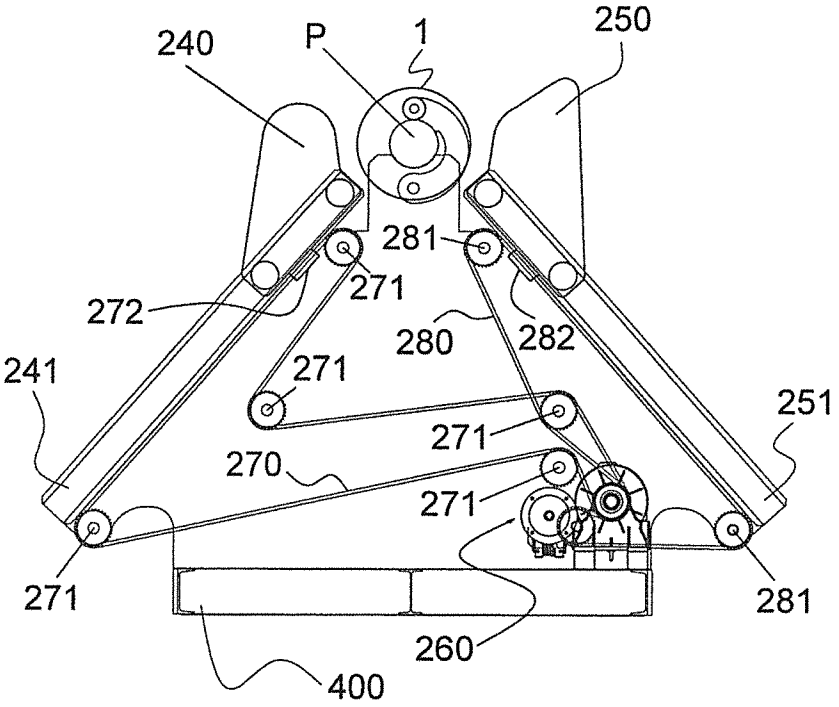
Figure 41:
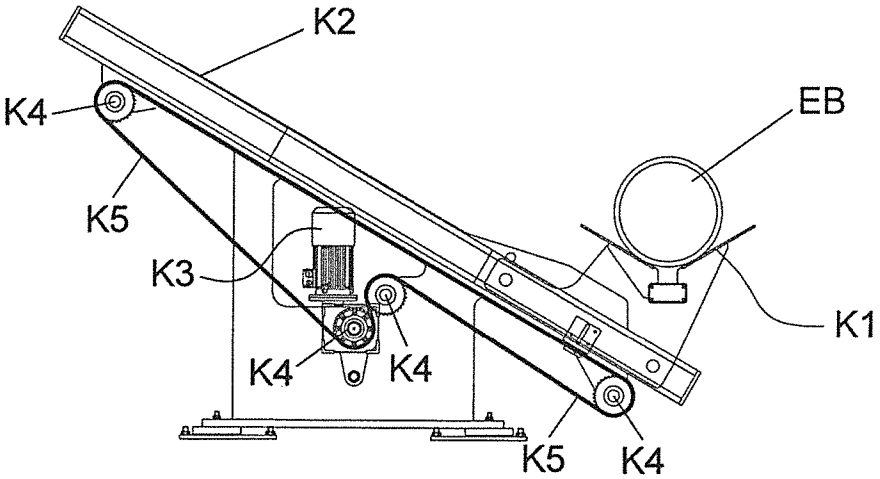
Figure 40:
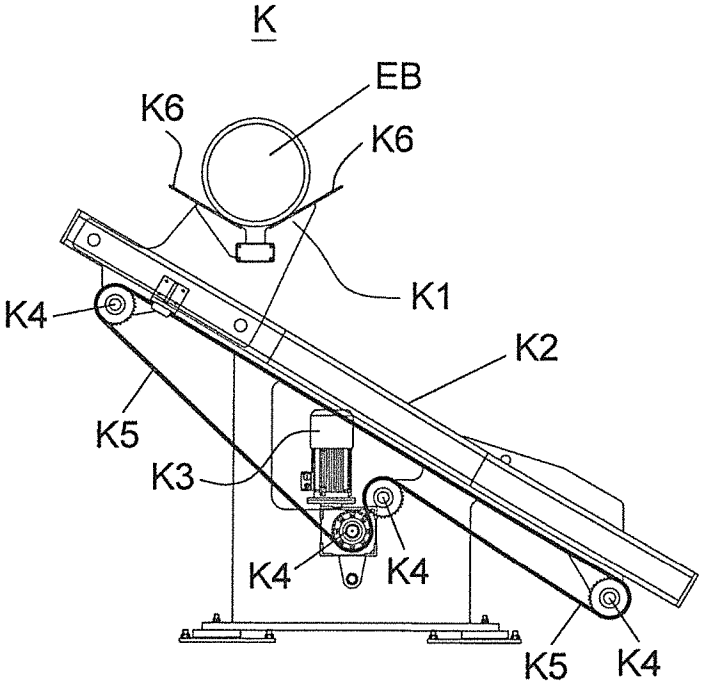
Figure 42:
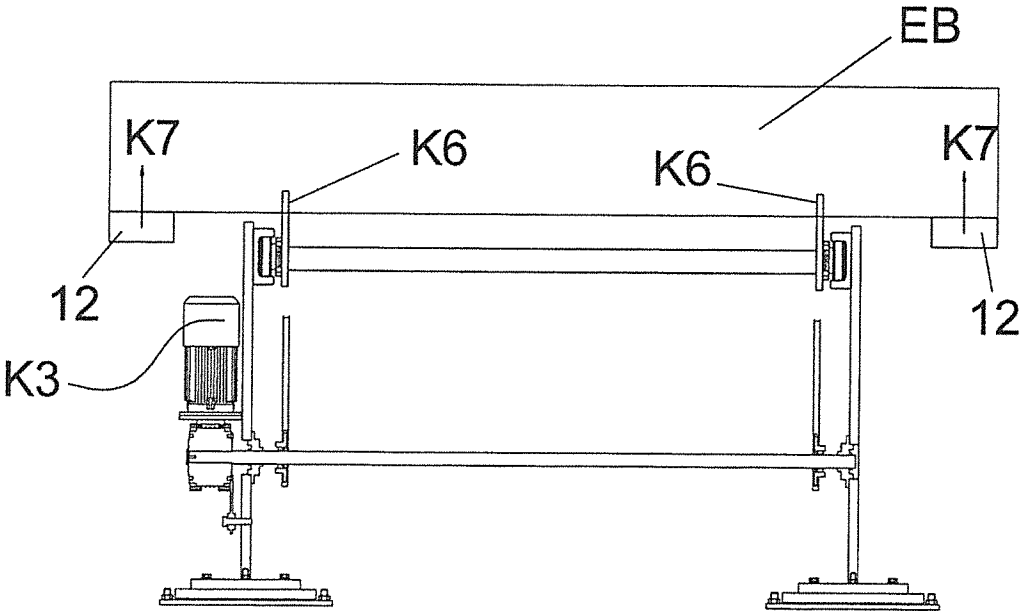

FIG. 4 schematically shows the position of said apparatus with respect to an unwinder (S) of a generic paper converting plant featuring four positions (A, B, C, D) for the parent reels (1) to be unwound and two exchange units (SU);

FIG. 5 is a simplified block diagram concerning a possible configuration of an auomatic control system for the apparatus shown in FIGS. 1-4;

FIG. 6 is a schematic perspective view of a pin that can be used for carrying out a method according to the present invention;

FIG. 7 shows the pin of FIG. 6 with two sectors removed to better show the inside;

FIG. 8 is a cross section view of the pin shown in FIG. 6;

FIG. 9A is a section along line A-A of FIG. 8;

FIG. 9B shows a group of components isolated from the unit shown in FIG. 9A;

FIG. 10 is similar to FIG. 9A but shows the pin in the compressed configuration instead of the expanded configuration;

FIGS. 11-16 schematically show a sequence of steps concerning the handling of the pin by means of a bridge crane, where the parent reel is shown in FIG. 11 only to illustrate the movements more clearly;

FIG. 17 is a schematic side view of the parent reel with the pins inserted in the opposite ends of the respective core;

FIGS. 18 and 19 are two details of FIG. 11;

FIG. 20 shows the forces (RA) acting on the parent reel (A) when the latter is raised;

FIG. 21 schematically shows a side view of a bridge crane with the ends of the respective arms properly aligned with the longitudinal axis of a parent reel positioned on a support;

FIGS. 22A and 22B show the group of FIG. 21 in front view in two different configurations;

FIG. 23 is a schematic side view of the bridge crane with with the ends of the respective arms above the longitudinal axis of the parent reel;

FIG. 24 shows the group of FIG. 23 in front view;

FIG. 25 is a schematic side view of the bridge crane with with the ends of the respective arms below the longitudinal axis of the parent reel;

FIG. 26 shows the group of FIG. 25 in front view;

FIG. 27 is a schematic view from the above of an actuator (AP) and its connection to the corresponding superstructure (SC);

FIG. 28 is a perspective view of an arm of the bridge crane with its superstructure;

FIGS. 29A and 29B schematically show the platform (PB) in the lowered and respectively raised platform;

FIG. 30 is a schematic block diagram of a possible automatic control system that can be used in connection with the device shown in FIGS. 21-29;

FIG. 30B shows a wrong position of a pin with respect to the parent reel;

FIGS. 31-36 schematically show, in side view, an unwinder that can be used to carry out a method according to the present invention with a sequence of configurations from a starting time in which the diamter of the parent reel is maximum (FIG. 31) to a final time in which the diameter of the parent reel is minimum (FIG. 36);

FIG. 37 schematically shows a simplified block diagram relating to the movement of the carriages supporting the pulley-shaped followers;

FIG. 38 is an enlarged detail of FIG. 33;

FIG. 39 si similar to FIG. 36 but illustrates, in particular, a possible mechanism for moving the carriages (240, 250);

FIGS. 40 and 41 are side views of a device for receiving the exhausted reels;

FIG. 42 is a front view of the device shown in FIGS. 40 and 41.

A method according to the present invention can be carried out, for example, by a plant comprising:

an apparatus for supporting and orienting the parent reels (1) at a parking station (SA);

two pins (P) that can be inserted each in a corresponding end of the core (10) of a parent reel (1);

a bridge crane (CP) having two mobile arms (BC);

an unwinder (S).

For example, said supporting and orienting apparatus for the parent reels (1) comprises a support (110) adapted to receive and support a parent reel (1) made of paper wound according to a given winding direction, the paper having a side smoother than the other side and turned towards the inside or towards the outside of the parent reel. Said support (110) comprises a base (11) on which is mounted a rotating platform (10) provided with appendixes (12) that form a bilateral support for the parent reel (1). Said appendixes (12) have a reversed "L"-shaped cross section to delimit an inner space (13) accessible to the forks of a forklift (not shown in the drawings) by means of which the parent reel (1), coming from another point of the paper converting plant where the supporting and orienting apparatus is positioned or coming from an external facility, is positioned on the rotating platform (10). The platform (10) is mounted on the base (11) through a ring (14) so that the platform (10) can rotate on the base (11) about a vertical axis (y-y) on which the ring (14) is centered. The rotation of the platform (10) is driven by an electric motorgear (100) acting on the platform (10) through a gear transmission comprising a pinion (101) that engages the external side of the ring (14), the latter being correspondingly toothed on its external side. The motorgear (100) is mounted below the base (11) and its output shaft (102) crosses orthogonally the same base (10) that exhibits a corresponding through hole; on the other side of the base (11), i.e. Above it, a pinion (101) is mounted on the free end of said shaft.

Figure 3:
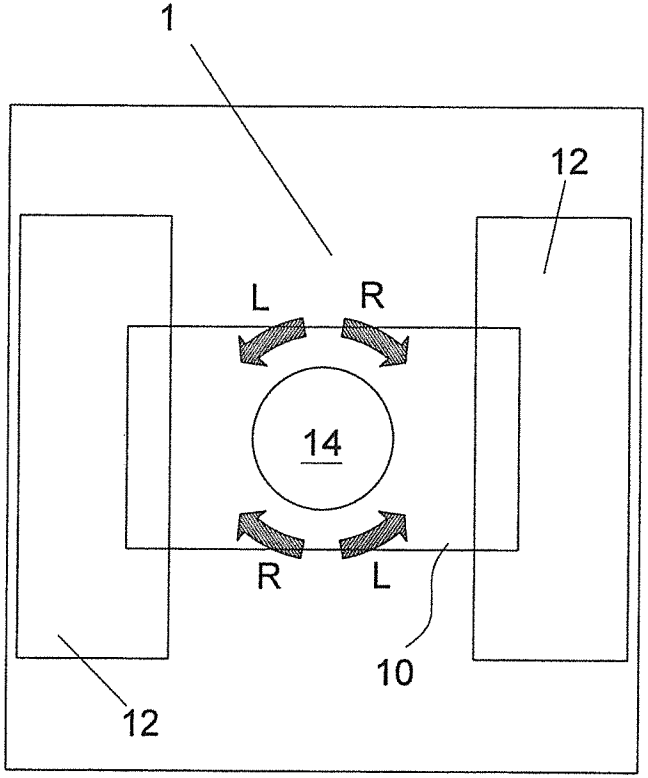
FIG. 3 is a schematic view from the bottom of the apparatus shown in FIGS. 1 and 2.

In practice, thanks to the support (110) the parent reel (1) can be rotated about the axis (y-y) to be properly oriented with respect to the unwinder (S). In FIG. 3 the arrows "R" and "L" show the rotation of the parent reel (1) about the axis (y-y).

For example, with reference to FIG. 4, if the smoother side of the parent reel (1) is the external side and the "free tail" of the same parent reel (1) is the right tail (DB) turned towards the unwinder (S): if the parent reel (1) is destined to position (C) or to position (D), then the parent reel (1) is left in its original orientation; if the parent reel (1) is destined to position (A) or to position (B), then its orientation is modified through a 180° rotation of platform (10) about the axis (y-y). If, again assuming that the smoother side of the paper wound on the parent reel (1) is the external side, the free tail of the paper reel (1) is the left tail (SB): if the parent reel (1) is destined to position (A) or position (B), then the parent reel (1) is left in its original orientation; if the parent reel (1) is destined to position (C) or to position (D), then its orientation is modified through a 180° rotation of platform (10) about the axis (y-y).

The exchange units (US) are known per se and are destined to join the end portion of an almost exhausted parent reel with the initial porion of another parent reel provided on the opposite side of the exchange unit. Examples of unwinders associated with exchange units are disclosed in EP1742860 and EP1601600.

The apparatus for orienting the parent reel (1) disclosed above ensures that the smoother side of the paper will be the external side of the product obtained by joining (with known methods) the plies exiting the exchange unit (S). In fig.4 the external sides of two plies (V1, V2) exiting the exchange unit (S) are denoted by references "L1" and "L2". The arrow "E" shows the direction of the plies (V1, V2) exiting the exchange unit (S) and directed towards a joining unit located downstream (known per se and therfore not described in detail; for example, said unit can be a glueing unit or a ply-bonding unit).

The orientation of the parent reel (1) in the parking position is recognized by an operator who, making use of a keyboard (K), enters this information into a programmable unit (UE) to which the motorgear (100) is connected. Then, the programmable unit (U) drives the rotation of the platform (10) or not on the basis of the orientation of the parent reel (1) as entered by the operator and on the basis of the destination (A, B, C, D) as previously disclosed.

The step of sensing the orientation of the parent reel can be controlled by automatic sensing means adapted to sense if the smoother side of the paper wound on the parent reel (1) is the external or the internal side.

For example, said automatic sensing means comprise an optical reader (OR) or a reader (TR) adapted to read RFID tags. In the first case, on the external side of the final portion of the parent reel (1) is applied a sign (for example a geometric shape or a barcode) that can be sensed by the optical reader (OR) and identifies such side as the smoother or the rougher side. In the second case, an RFID tag is applied on the final portion of the parent reel, having the same function as disclosed for the geometric shape and the barcode. The sign or the barcode or the RFID tag can be provided on the reel in the paper mill where the reel is produced or in the paper converting plant.

The keyboard (K), the optical reader (OR) and the tag reader are examples of means of consent to the activation of the means of orientation of the parent reel (1) and are activated on consent given through the keyboard (K), the optical reader (OR) or the tag reader.

The platform (10) may also be configured to simultaneously accommodate more than one parent reel (1).

According to the examples shown in the drawings, each pin (P) has an outer side (PX) and an inner side (PN), the inner side (PN) being destined to be inserted into the core (10) of the reel (1) and the outer side being external to the same reel (1) when the inner side (PN) is inside the core (10). In FIG. 6 and FIG. 7 the outer side (PX) is on the right while the inner side (PB) is on the left. The pin (P) is substantially simmetrical with respect to a central longitudinal axis (x-x).

The outer side (PX) of the pin (P) is constituted by a shank (2) whose longitudinal axis coincides with the longitudinal axis (x-x) of the pin (P). On said shank (2) is fixed a handle (3), formed by two parallel arms (30) emerging radially from the shank (2) and joined by a body (31) parallel to said longitudinal axis (x-x). The handle (3) is applied on the upper side of the shank (2), i.e. on the side of the latter which, in operation, is turned upwards. The shank (2) is hollow.

According to the example shown in the drawings, the inner side (PN) of the pin (P) is expandable: said inner side is expanded (as shown in FIG. 6, FIG. 7, FIG. 8, FIG. 9A and FIG. 9B) when it is inserted in the core (10) of the reel (1) so as to engage the latter, while it is compressed (as shown in FIG. 10) in order to be inserted in the core (10) or disengaged from the reel.

The outer surface of the inner side (PN) is formed by more sectors (4), four in number in this example, each of which is formed by a portion of cylindrical surface with a free front end (40) and a rear end (41). The pin (P) also comprises a body (5) having: a rear part (50) inserted longitudinally in the hollow shank (2) with the interposition of bearings (51);

a front part (52) turned towards the front end (40) of the sectors (4) and consisting of a longitudinal extension of the rear part (50); and an outer cup-shaped part (53), whose inner diameter (d53) is greater than the outer diameter of the shank (2), in an intermediate point between the rear part (50) and the front part (52). In practice, the rear part (50) of body (5) is inserted in the shank (2), the intermediate part (53) is external to the shank that in part (i.e. on its most advanced part) is inside the cup-shaped intermediate part (53), and the front part (52) constitutes a prolongation of the body (5) that, as shown in the drawings, is internal to the sectors (4).

The rear end (41) of each sector (4) is constrained to the cup (53) of the body (5) by a pin (42) inserted in a radial wing (54) projecting externally from the same cup (53). Said wings (54), in this example, are four in number and are arranged at an angular distance of 90° from each other. The axis of each pin (42) is oriented along a tangential direction relative to the shank (2) whose surface is cylindrical. In addition, each pin (42) is spaced apart a predetermined value from the outer surface of the shank (2), being inserted in a wing (54) which acts as a spacer.

According to the example shown in the drawings, the sectors (4) are identical to each other and are separated by separation lines or discontinuities (S4) so as to allow their movement (as further described below) without interference. Furthermore, in the example, each of the sectors (4), seen from above, has a trapezoidal shape with the larger base in correspondence with its rear side (41).

Each sector (4) is also constrained to the front part (52) of said body (5) via a connecting rod (55) hinged on one side (lower side) on a collar (56) mounted longitudinally slidable on the front (52) of the body (5) and, on the opposite side (upper side), on the inner surface of the respective sector (4). The connection of the connecting rod (55) to the collar (56) is formed by a pin (57) whose axis is parallel to the pin (42) that connects the rear part (41) of the sector (4) to the respective wing (54) of the cup (53); the connection of the same connecting rod (55) to the inner side of the sector (4) is made by means of a further pin (58) parallel to the previous one (57). In front of the front end of the front part (52) of the body (5) is arranged a pneumatic spring (6) placed between two plates (60, 61) that are orthogonal to said axis (x-x). The first plate (60) has a rear extension (62) which acts as a spacer and is fixed to the front end of the front part (52) of the body (5). The second plate (61) is on the opposite side with respect to the pneumatic spring (6). Several rods (63) connect the second plate (61) with said collar (56): each rod (63) is fixed on one side to the second plate (61) and, on the opposite side, to a rear appendix (560) of the collar (56) and passes freely through a respective hole formed in the first plate (60). On each of the rods (63) is mounted a helical spring (64). The rods (63) and the helical springs (64) are oriented parallel to said axis (x-x) and are four in number in the example shown in the drawings.

When the pneumatic spring (6) is discharged, that is, compressed, the action of the helical springs (64) is such as to maintain the collar (56) set back on the part (52) of the body (5): in this condition the rear part of the collar (56) is pushed by the springs (64) against an abutment surface (59) exhibited by the body (5) between its intermediate part (53) and the front part (52), and the sectors (4) are open, with the connecting rods (55) oriented along a radial direction, relative to the axis (x-x), that is oriented parallel to the load acting on the pin (P).

The sectors (4) are kept normally open by the springs (64).

When the pneumatic spring (6) is charged, i.e. expanded, the resistance of the springs (64) is overcome and the collar (56) advances, together with the foot of the connecting rods (55), whereby the sectors (4) are closed with reciprocal approaching of the respective front ends (40).

The compressed air is introduced into the pneumatic spring (6), or removed, through a longitudinal through hole (5F) formed in the body (5). In this way, the sectors (4) can be opened and closed by rotating them about the pins (42).

Therefore, an expanding pin in accordance with the example described above uses an external source of energy to switch between an expanded configuration to a contracted configuration. In the example, the energy supplied from the outside is conveyed by compressed air.

The front ends (40) of the sectors (4) form a substantially circular shape whose outer diameter (4*a;* 4*c*) varies according to the configuration (open/closed) of the same sectors (4) between a maximum value (4*a*) and a minimum value (4*c*). Advantageously, the difference (A) between said maximum value (4*a*) and said minimum value (4*c*) is between 10% and 30% of the maximum value (4*a*): $0.30*(4a) \geq \Delta = (4a-4c) \geq 0.10*(4a)$.

Preferably, said difference (Δ) is comprised between 15% and 20% of the maximum value (4*a*): $0.20*(4a) \geq \Delta = (4a-4c) \geq 0.15*(4a)$.

More preferably, said difference (Δ) is comprised between 15% and 18% of the maximum value (4*a*): $0.18*(4a) \geq \Delta = (4a-4c) \geq 0.15*(4a)$.

FIGS. 11-16 show a possible sequence of movements related to the loading of a parent reel (1) on an unwinder (S) provided, on each of its sides, with a movable semi-collar (SM) controlled by an actuator (AS) that—in a manner per se known—by means of levers (LS) makes it rotate clockwise (closing direction) or counterclockwise (opening direction) above a fixed support cradle (SF): when the pin (P) is above the cradle (SF), the rotation of the movable semi-collar (SM) in a clockwise direction causes the engagement of the outer part (PX) of the pin (P) with the respective side of the unwinder (S). On the contrary, the counterclockwise rotation of the movable semi-collar (SM) determines the release of the pin (P) from the unwinder (S).

In FIG. 11 the parent reel (1) with the pins (P) inserted in both ends of its core (10) is hooked to the movable arms (BC) of the bridge crane (CP) while the mobile semi-collars (SM) of unwinder (S) are open. In particular, each movable arm (BC) of the bridge crane (CP) is provided, on its free end, with a movable hook (G) which, in turn, has a hook-shaped free end to be more easily placed under the body (31) of the handle (3). The hook (G) is hinged on the free end of said movable arm (BM) by a pin with horizontal axis (PG) and has a rear side connected to a pneumatic spring (MP) by which the same hook (G) can be rotated clockwise or counterclockwise about the pin (PG). The movement of the movable arm (BC) is controlled by a respective actuator (AP).

Figure 12:
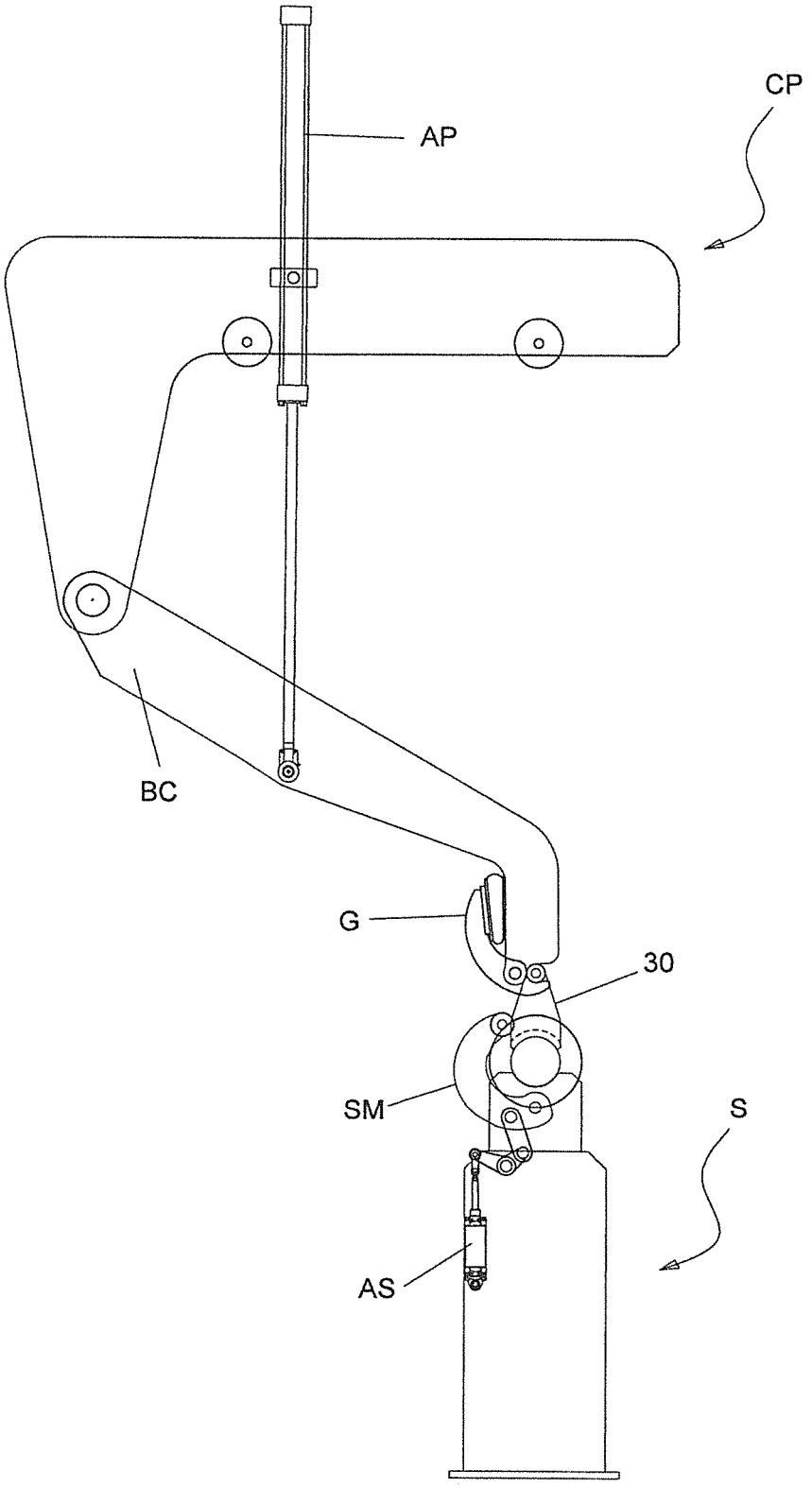

In FIG. 12 the movable arm (BM) of the bridge crane (CP) has been lowered by means of the actuator (AC), the pin (P) is on the cradle (SF) of the unwinder (S), the hook (G) holds the handle (3) and the mobile semi-collars (SM) are open.

Figure 13:
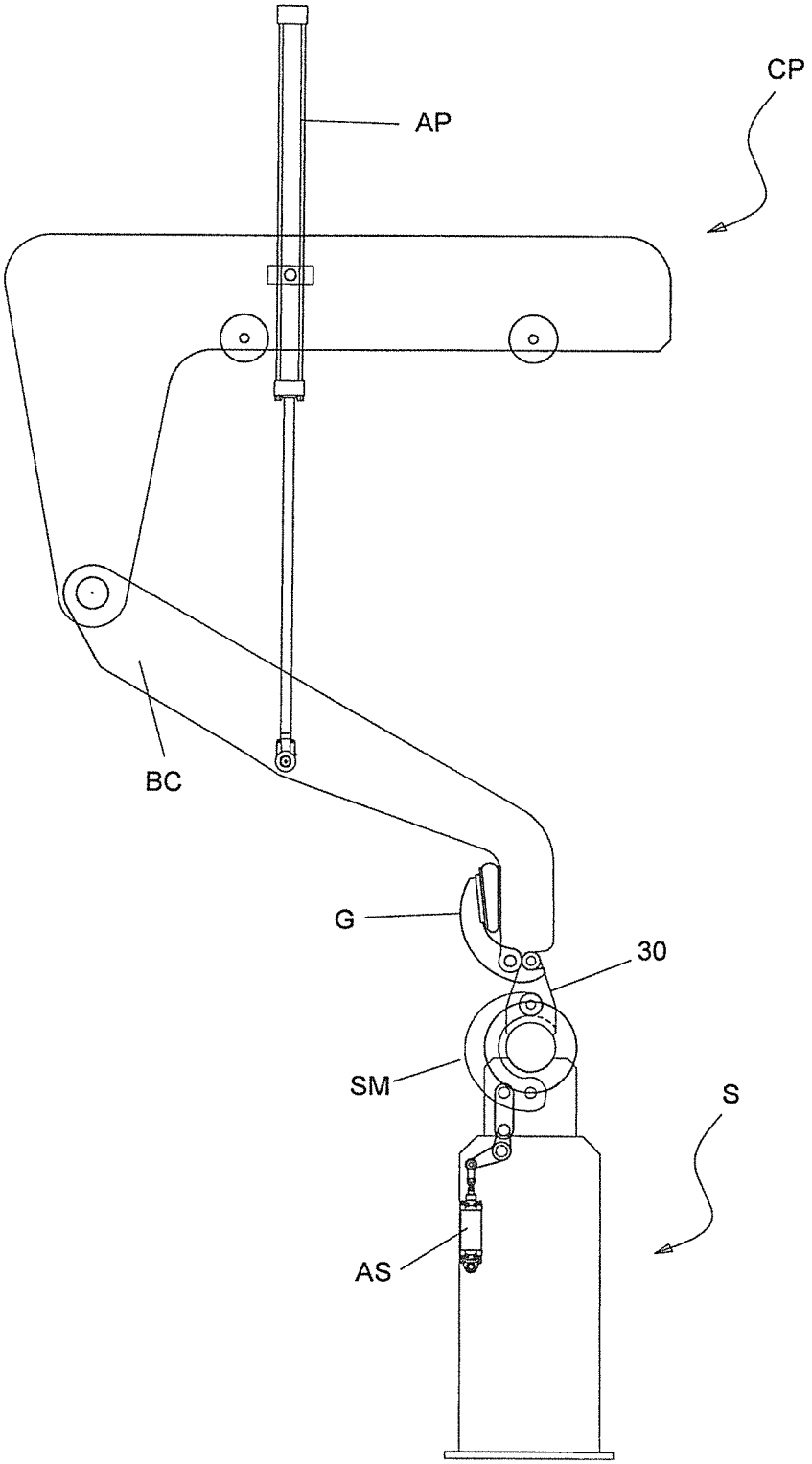

In FIG. 13, while the hook (G) still retains the handle (3) of the pin (P), the semi-collars (SM) are rotated clockwise to lock the pin (P) to the unwinder (S).

Figure 14:
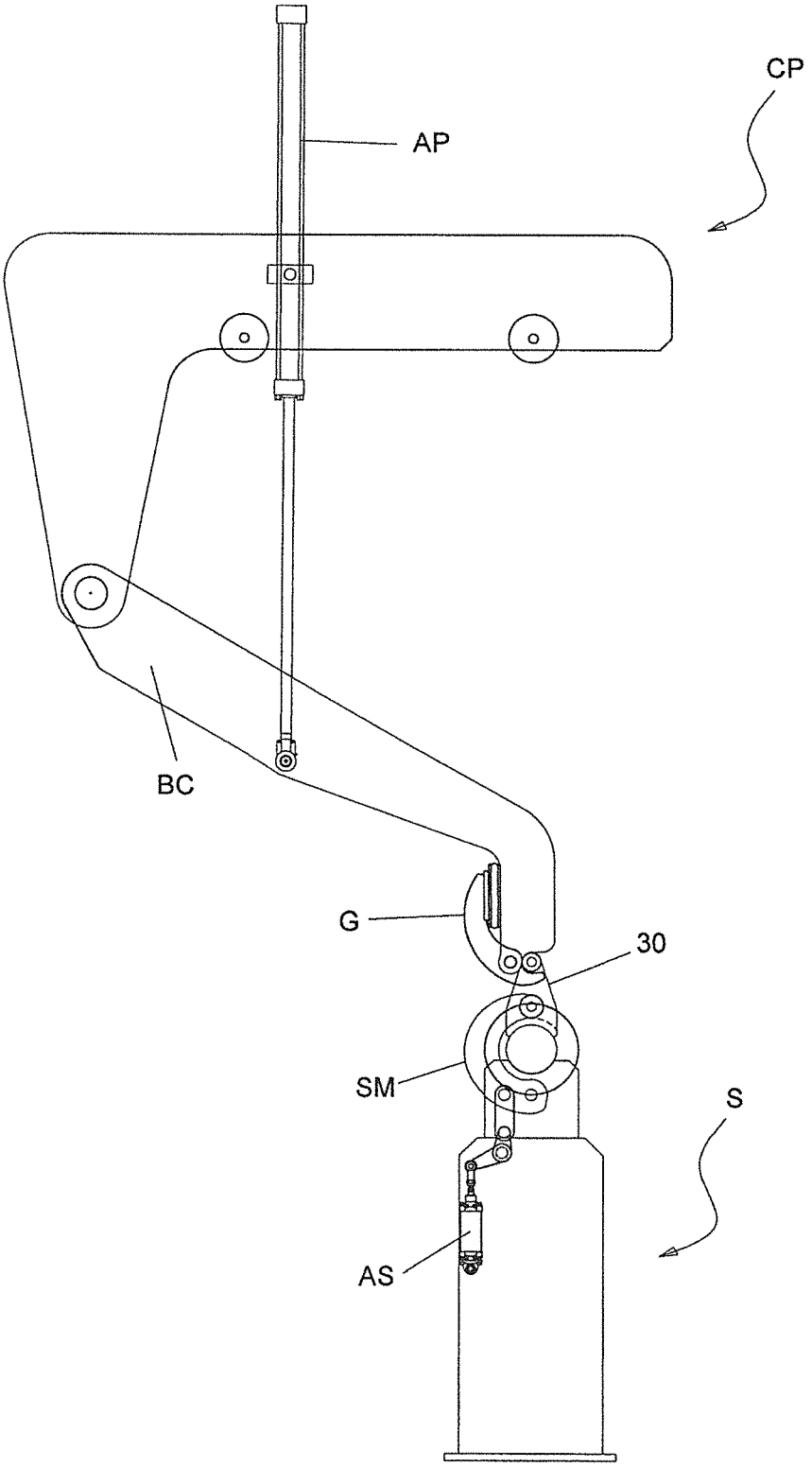

In FIG. 14 the hook (G) of the bridge crane (CP) is rotated to release it from the handle (3) of the pin (P).

Since the arms (BC) of the bridge crane (CP) are moved to obtain their mutual approach and spacing, as schematically shown by the double arrow "FB" in FIG. 17, the same arms (BC) are apt to provide for the insertion of pins (P) in the two ends of the core (10) of the reel(1) and, respectively, for their disconnection.

Figure 15:
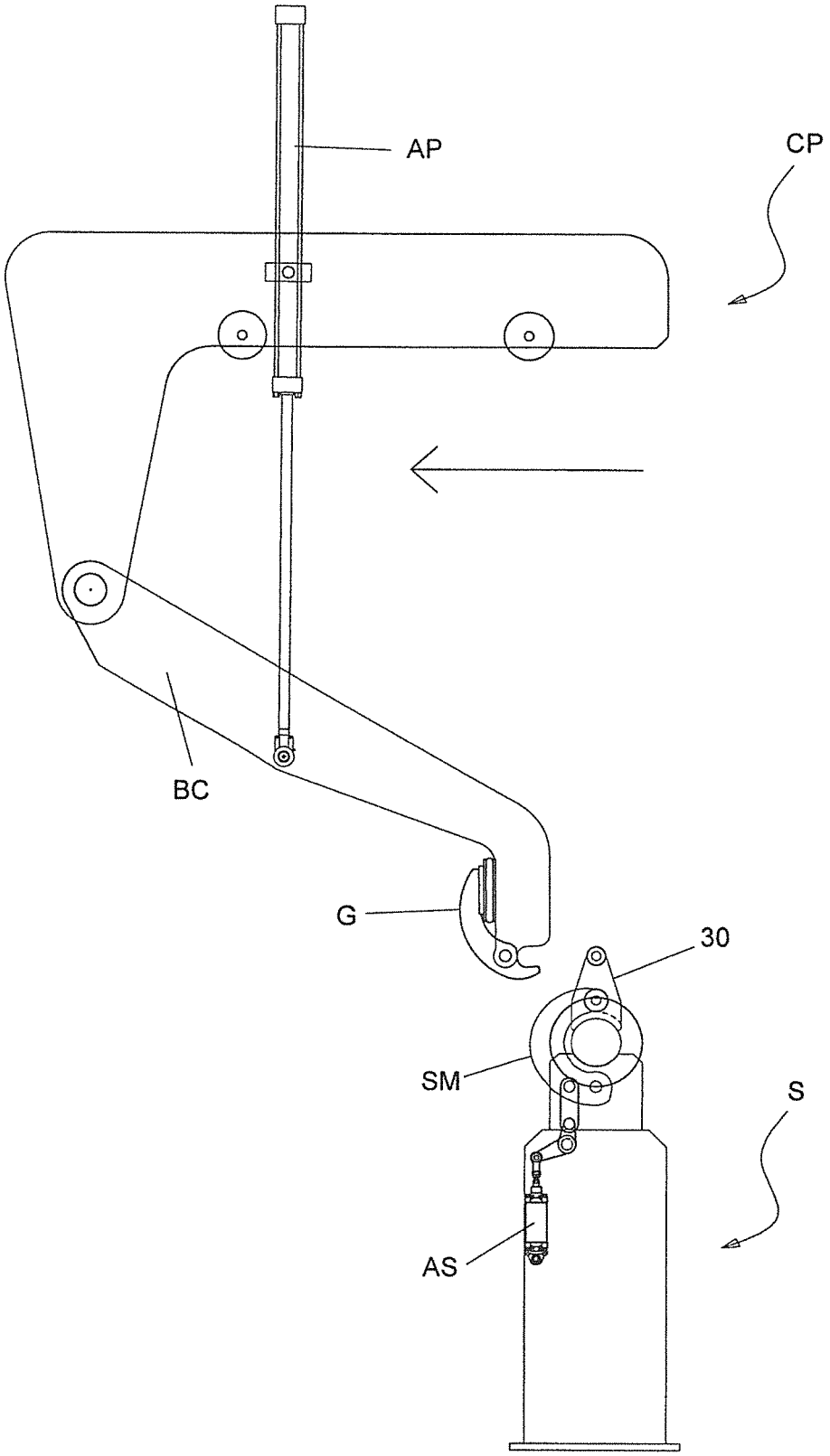
Figure 16:
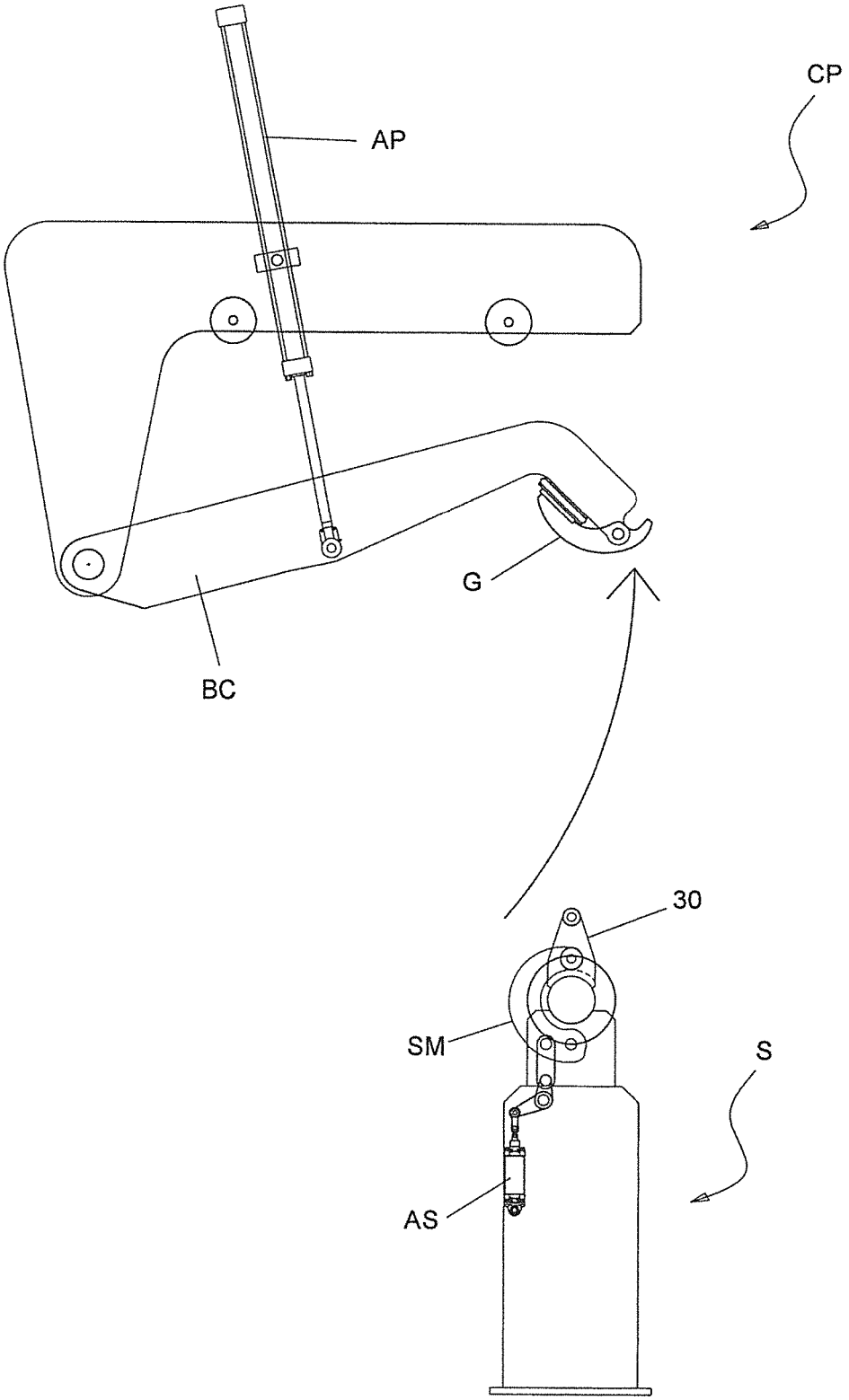

FIG. 15 and FIG. 16 show the mobile arm of the bridge crane that moves away from the unwinder (S).

To disengage the reel (1) with pins (P) from the unwinder (S) the sequence is opposite to that described above.

As previously mentioned, the handle (3) on the pin (P) allows the hooking of the latter to the respective arm of the bridge crane while the same pin (P) is still on the unwinder (S).

It is noted that the reel is always supported by the arms (BC) of the bridge crane (CP) or by the unwinder (S) or by both these elements.

Moreover, thanks to the handles (3) which, as mentioned earlier, are hooked to the hooks (G), each of the pins (P) can oscillate on its hook (G), and this favors the self-alignment of the pins (P) with the axis of the reel (1) during insertion of the pins in the core (10) of the latter.

FIG. 20 schematically shows the forces (RA) acting on the reel (1) during the raising of the same: the distribution of forces is such as to avoid, or at least greatly reduce, the bending of the core (10) which, in addition, is not subject to appreciable buckling loads.

With reference to the example shown in FIGS. 21-30, each of the arms (BC) of the bridge crane (CP) is connected, by a hinge with horizontal axis (C-C), to a lower appendix (LC) of a superstructure (SC). The latter is mounted on a carriage (CA) slidably mounted (by means of an electric motor not shown in the drawings, in a conventional manner) along a rectilinear guide (GR) placed at a predetermined height with respect to the lower base of the platform (PB).

Said guide (GR) is shown only in FIG. 21 and FIG. 22, where the references "RC" indicate the wheels of the carriage (CA) able to slide on the beams that form the guide (GR), while in the other figures it is not represented for simplicity. The two superstructures (SC), and the related appendices (LC) and the movable arms (BC), can be mutually approached or moved away, that is, can be moved orthogonally to the sliding direction (F) of the bridge crane (CP) along the guide (GR). In FIG. 22, FIG. 24 and FIG. 26 arrows (H) represent the mutual approach of the arms (BC) during insertion of the pins (P) engaged to them in the respective end of the core (10) of the reel (1). For this purpose, each of the two superstructures (SC) is integral with a second carriage (2C) equipped with wheels (2R) sliding on guides (2G) presented by the top surface of the first carriage (CA). The carriages (2C) each is controlled by a related jack (2M) which controls its translation along the guides (2G) on the upper side of the first carriage (CA) that are developed along a direction orthogonal to that of the beams that define the guide (GR) on which runs the first carriage (CA). Each jack (2M) is fixed with his mantle to a bracket fixed in central position on the first carriage (CA) and with the stem connected to an inner side of the respective superstructure (SC). In this way, each of the said superstructures (SC), with the respective arm (BC), can be moved, bidirectionally, both along the guide (GR) and orthogonally to the latter.

The rotation of each movable arm (BC) about the axis of the hinge (CC) is controlled by a respective actuator (AP) which has the skirt (100) attached to the superstructure (SC) and the stem (101) coupled to the movable arm (BC). More particularly, said skirt (100) is hinged to a bracket (102) by means of a horizontal pin (106). The latter on one side (right side in the drawings) is hinged on the superstructure (SC) by means of a pin (103) with a horizontal axis oriented orthogonally to the same superstructure (outgoing from the sheet). On the side opposite to the pin (103), on the superstructure (SC) is applied a load cell (104) in a fixed position below the free end (105) of the bracket (102). In other words, the load cell (104) is in a fixed position below the end (105) of the bracket (102) opposite the end of the same bracket that is hinged to the superstructure (SC) by means of the pin (103). As can be seen in the detail of FIG. 28, the said superstructure (SC) is box shaped, as the bracket (102) that is positioned between two sides of the superstructure (SC). The pin (103) extends transversely to the sides of the superstructure (SC), while the pin (106), which is parallel to the shaft (103), extends transversely to the sides of the bracket (102).

As shown in FIG. 28, also the arms (BC) and the appendix (LC) are box-like shaped as the superstructure (SC). The pin (CC) that connects the movable arm (BC) with the appendix (LC) extends transversely to these elements. The actuator (AP) is placed between the sides of the arms (BC) and the superstructure (SC).

Three possible cases concerning the introduction phase of the pins (P) in the core (10) of the reel (1) are the following.

Case 1: the axis of the reel (1) is aligned with the axis (x-x) of the pins (P) and there are no significant changes in the weight on the load cell (104) during the introduction of the pins (P) in the reel core. This case is illustrated in FIG. 21 and FIGS. 22A-22B. In particular, in FIG. 22A the arm (BC) on the right is already introduced the respective pin (P) in the core (10) of the reel (1), while the arm (BC) of the left is still "open", that is, the respective pin (P) is out of the reel (1). In FIG. 22B both arms (BC) are "closed", that is, both pins (P) are inserted in the reel (1). It goes without saying, however, that the two arms (BC) can be moved as indicated by arrows "H" simultaneously.

Case 2: the axis of the core (10) of reel (1) is lower than, i.e. below, the axis (x-x) of the pins (P) and during the introduction of the pins these cause the lifting of the reel (1) so that the load cell (104) senses an increase of the weight value that exceeds a predetermined limit. In this case, the platform (PB) on which is placed the reel (1) corrects the position of the latter by lifting it, as further disclosed in the following, until the load sensed by the load cell is thaat due to the weight of the pins (P) only.

Case 3: the axis of the core (10) of reel (1) is higher than, i.e. above, the axis (x-x) of the pins (P) and during the introduction of the pins these are subject to lifting so that the load cell (104) senses a decrease of the weight value that exceeds a predetermined limit. In this case, the platform (PB) on which is placed the reel (1) corrects the position of the latter by lowering it, as further disclosed in the following, until the load sensed by the load cell is that due to the weight of the pins (P) only.

For example, the platform (PB) can be raised and lowered by means of a pantograph mechanism disposed and acting under the same platform (PB). In this way, it is possible to adjust the height of the platform and, thus, the height of the core (10) of the reel (1) with respect to the pins (P) connected to the arms (BC) of the bridge crane (CP). Said mechanism comprises a lower base (200) and an upper base (201) joined by means of levers (202) hinged to each other and on the same bases (200, 201) and connected by an actuator (203). The latter, in a per se known manner, determines, when it is activated, the rotation of the levers (202) and, then, the lifting or the lowering of the upper base (201) on which is arranged the platform (PB). Consequently, it is obtained the lifting or lowering of the reel (1). It is understood that the mechanism for lifting/lowering the platform (PB) can be of any other type. For simplification, in FIGS. 21, 23 and 25 the mechanism for lifting/lowering the platform (PB) is not shown.

The bracket (102) and the load cell (104) constitute, according to the example described above, a possible embodiment of a device for detecting the load variations on the arms (BC) of the bridge crane (CP). Said device can be connected to a programmable unit (UP), as in the simplified diagram of FIG. 30, which controls the lowering or raising of platform (PB) by acting on the actuator (203) to cancel these variations.

FIGS. 21-30 illustrate, therefore, a device comprising a bridge crane (CP) with movable arms (BC) each suitable to engage a pin (P) insertable into a corresponding side of a reel (1) and a platform (PB) located below the said base (11) for supporting the reel (1); and comprises detection means adapted to detect load variations on said arms (BC) during insertion of the pins (P) in the reel (1), and movement means able to achieve a relative vertical movement between the reel (1) and the arms (BC) when the absolute value of a load variation detected by said detection means exceeds a predetermined limit, up to bring said value below the predetermined limit.

In the device shown in FIGS. 21-30 said movement means are adapted to move vertically the reel (1) with respect to the arms (BC); said movement means comprise a mechanism for lowering and lifting said platform (PB); said mechanism for lowering and lifting the platform (PB) is a pantograph mechanism; said means for detecting the load variations on the arms (BC) comprise, for each arm (BC), a load cell (104) applied in a fixed position on a structure (SC) of the bridge crane (CP) to which the arms (BC) are connected, and a body (102) adapted to interfere with the load cell (104), each body (102) being connected to the respective arm (BC); each body (102) is connected to the respective arm (BC) by means of an actuator (AP) that connects the same arm (BC) with said structure (SC); said detection means and said movement means are connected to a programmable unit (UP) which receives electrical signals emitted by the detection means and controls the movement means and is programmed to actuate the movement means according to the signals emitted by the detection means.

It is understood that the above-mentioned correction can be implemented by lowering or raising the arms of the bridge crane and leaving the platform (PB) in a fixed position. In this case, the unit (UP) will be connected to the actuators (AP) to lower or raise the arms (BC) when, as previously mentioned, the load cell (104)—or another suitable detection device—detects a change of the load on the arms (BC) whose absolute value exceeds a predetermined limit, up to bring this value below the predetermined limit.

The means for detecting the load variation are also suitable to weigh the reel. In this way, it is possible to keep track of the amount of processed material, calculating the difference between the weight of the reel (1) at the origin and its weight at the end of the unwinding step.

Moreover, using a load cell suitably positioned with respect to the arms of the bridge crane, can be detected also changes in loads in the direction parallel to the axis of the reel (1). For example, with reference to the possible case illustrated in FIG. 31, the pin (P) is on the right and below the core (10): the variation of load in the direction parallel to the longitudinal axis of the reel during the approach of the arm carrying the pin (P) is greater than a predetermined limit (the pin P, in fact, is in a position in which it can not be inserted in the core of the coil 1). In such a condition, the control unit (UP) will command the stop of the arm which carries the pin (P) to prevent damage to the reel (1).

An unwinder (S) that can be used to implement a method in accordance with the present invention comprises a support (150), on which can be placed a parent reel (1), equipped with stop collars (SM). Each of the collars (SM) defines a constraint for a corresponding pin (P) inserted in a respective side of the reel (1). When the reel (1) is laid on the support (150), the collars (SM) are open. During the unwinding step, that is, while the reel (1) rotates about its own axis (x-x) and about the axis of the pins (P), the collars (SM) are closed (as in FIGS. 31-36). When the reel (1) is exhausted and must be removed from the support (150) to replace it with a new one, using the bridge crane (CP), the collars (SM) are open again. The support (150), as well as the the collars (SM) are of the type known to those skilled in the art and, therefore, are not described in greater detail.

Moreover, the unwinder (S) comprises a plurality of ring-closed belts (C2) driven by pulleys (20, 21, 22, 23, 24, 25) with two pulleys (20, 21) placed at corresponding fixed positions, one pulley (22) also placed at a fixed position and connected with an electric motor so as to act as a driving pulley, a tensioning pulley (23) applied on a shaft that can be moved horizontally by means of an actuator (300) solid to an underlying fixed base (400), and two follower-pulleys (24, 25) whose distance from the longitudinal axis of reel (1) is constant. More particularly, the follower-pulleys (24, 25) are placed each on a corresponding carriage (240, 250) that is free to slid along a guide (241, 251) radially oriented with respect to the axis of reel (1), i.e. Oriented radially with respect to the collar (SM). In FIGS. 31-36 the belts are represented by dashed lines to better show their configuration. As shown in FIGS. 31-36, said guides (241, 251) are on opposite sides with respect to the collar (SM) and are diagonally oriented with opposite inclination angles, such that their respective upper ends are turned towards the center of the collar (SM) provided on the support (150).

In other words, the guides (241, 251) are oriented with their upper ends converging radially towards the center of the collar (SM) where the longitudinal axis of the reel (1) passes. The carriages (240, 250) are operated by an electric motorgear (260) that is shown in FIG. 37 and FIG. 39 only. The output shaft of the motorgear (260) drags two chains (270, 280) driven by corresponding driving pulleys (271, 281). The chains (270, 280) and the motorgear (260) are inside the guides (241, 251), that is, in the space delimited by said guides. Each carriage (240, 250) is connected, on its lower side, to a corresponding chain (270, 280). The points where the carriages (240, 250) are connected to the chains (270, 280) are dentoted by reference numerals (272) and (282).

As shown in the drawings, the pulleys (20, 21, 22, 23, 24, 25) are arranged in such a way that the belts (C2) are below the reel (1).

On a carriage (240) is mounted a photocell (F5) whose optical axis is directed towards the reel (1). The position of the photocell (F5) on the carriage (240) is fixed. For simplification, the photocell (F5) is shown only in FIG. 31 and in the block diagram of FIG. 37.

The light beam generated by the photocell (F5) is intercepted by the reel (1) as long as the distance between the same photocell (F5) and the reel (1) is equal to a predetermined value (first operating condition).

When, due to the decrease in diameter of the reel (1) caused by the unwinding of the paper material, the distance between the photocell (F5) and the reel (1) exceeds the predetermined value, the light beam is no longer intercepted by the reel (1) and this corresponds to a second operating condition.

In the first operating condition, the carriages (240, 250) and the related pulleys (24, 25) are stationary.

In the second operating condition, the carriages (240, 250) are approached to the reel (B), i.e. they are raised synchronously along the respective guides (241, 251), until the restoration of the first operating condition. Simultaneously the actuator (300) moves the pulley (23) to maintain the proper tension on the belts (C2) while the configuration of the latter changes.

For this purpose, the photocell (F5) is connected to a control unit (UC) which controls the motor (260) and is equipped with a panel (PS) in order to set the aforesaid distance to the desired value.

In this way, while the diameter of the reel (1) decreases, there is always a branch (200) of the belts (2) that copies the lower side of the same reel (1) and has an angular amplitude (a) substantially constant, the angle (a) being observed between the axis (x) of the reel (1) or of the respective pin (P) and the contact points of the upper branch (200) of the belts (C2) with the reel (1) as shown in FIG. 38.

In practice, the distance (d) between the follower-pulleys (24, 25) and the reel (1) remains constant while the paper web unwinds from the reel (1). Yet in other words, the upper branch (200) of the belts (C2) follows the variation in diameter of the reel (1) because it raises and copies the lower side of the latter.

Therefore, regardless of the diameter of the reel 1) during the unwinding of the paper, the belts (C2) always act in an optimal way on the same reel, copying perfectly the profile of the latter in the area (200) where they exert the drag action.

By way of example, the initial diameter of the reel (1) is 3000 mm and the final diameter is 500 mm.

The photocell (F5) may be replaced by any other device suitable to detect the distance of the carriage (240), and then the photocell (F5), from the reel (1).

Therefore, the unwinder (S) described above comprises:

dragging means with variable configuration which act by contact on a reel (1) and are adapted to cause a rotation of the same reel about the respective longitudinal axis with a predetermined speed;

reconfiguration means adapted to vary the configuration of said dragging means in function of the instantaneous diameter of the reel (1);

control means (F5; CU) adapted to control the means of reconfiguration such that the contact between the reel (B) and said dragging means is provided on a contact area (200) of substantially constant angular amplitude (a) while the diameter of the reel (1) varies.

According to the the example described above the dragging means with variable configuration are constituted by the belts (C2); the means of reconfiguration of the driving means are constituted by the carriages (240, 250) with the relative pulleys (24, 25); and the control means are constituted by the photocell (F5) and the programmable unit (UC). Furthermore, according to the example described above the dragging means are placed below the support (150) so as to act on the lower side of the reel (1).

The bridge crane (CP) is also used to remove the exhausted reels (EB) from the unwinder (S) and to move them towards an unloading position (K) adjacent to the platform (PB). In said unloading position (K) there is a carriage (K1) that is apt to slide alonge an inclined plane (K2) and is driven by a corresponding electric motor (K3) connected with the carriage by means of chains (K5) guided by pulleys (K4) provided in predetermined positions below the plane (K2). Said plane (K2) is oriented in such a manner to exhibit an upper side, where the carriage (K1) is moved to receive the exhausted reel (EB), and a lower unloading side. The bridge crane delivers the exhausted reel (EB) to the carriage (K1) waiting in the first, i.e. upper, position and then is moved to pick up the reel provided on the platform (PB) and to put it on the unwinder (S), as disclosed above, so that the new reel takes the place of the exhausted reel. Then, the carriage (K1) is brought to the lower side of plane (K2). Now, the platform (PB) is raised to take on it the exhausted reel thanks to the appendixes (12) of the rotating part (10) that engage the exhausted reel (EP) externally to the arms (K6) of the carriage (K1) positioned on said lower side as indicated by arrows (K7) in FIG. 42. Therefore, the platform used for the reels (1) destined to the unwinder (S) is also used to allow the removal of the exhausted reels (EB) with the fork lift apparatus with which the new reels are loaded on the same platform.

In practice the execution details may vary in any equivalent way in relation to the elements described and shown in the drawings, without departing from the adopted solution idea and then remaining within the limits of the protection granted by the present patent.

The invention claimed is:

1. A method for handling parent reels in paper converting plants, the method comprising the following steps:

providing at least one platform with a base adapted to support a parent reel in a waiting station and at least one unwinder adapted to receive said parent reel in an unwinding station where the parent reel is unwound;

positioning the parent reel on the platform at the waiting station;

transporting the parent reel along a predefined path from said platform to said at least one unwinder via a bridge crane equipped with movable arms; and temporarily associating two pins with the movable arms of the bridge crane before transporting the parent reel along the predefined path and inserting the two pins in two opposite bases of the parent reel using the movable arms before transporting the parent reel along the predefined path, said transporting the parent reel along said predefined path comprising at least one ascending or descending portion with the two pins inserted into the parent reel, wherein each of the movable arms is moved to a position located at a spaced location from the two pins after the parent reel is transported along the predefined path.

2. A method according to claim 1, further comprising:

rotating the parent reel one-hundred and eighty degrees around a vertical axis before transporting the parent reel along the predefined path if an orientation of the parent reel on the at least one platform is different from a desired orientation.

3. A method according to claim 2, wherein the rotation of the parent reel is performed in said waiting station.

4. A method according to claim 3, wherein said rotation of the parent reel is performed with the parent reel positioned on said platform so that any rotation is performed with the parent reel in a not suspended position.

5. A method according to claim 2, wherein rotation of the parent reel is performed with the parent reel positioned on said platform so that any rotation is performed with the parent reel in a not suspended position.

6. A method according to claim 1, further comprising:

detecting possible load variations on said movable arms during insertion of the two pins in the reel, and providing a relative movement between the parent reel and the movable arms when an absolute value of a variation of a load exceeds a predetermined limit up to bring said absolute value below the predetermined limit.

7. A method according to claim 6, wherein the parent reel is moved vertically with respect to the movable arms.

8. A method according to claim 1, wherein each pin comprises an outer side and an inner side, the inner side being adapted to be inserted into the parent reel of paper material and the outer side remaining on an outside of the parent reel when the inner side is inside the parent reel, said outer side being provided with a hooking portion adapted to be engaged by a means for vertically moving at least one of the two pins.

9. A method according to claim 8, wherein the outer side of a respective pin comprises a shank having a longitudinal axis coinciding with a longitudinal axis of the respective pin and said hooking portion comprises an eyelet formed on the shank and delimited by two parallel arms that emerge radially from the shank and the two parallel arms are joined by a body parallel to said longitudinal axis of the respective pin.

10. A method according to claim 9, wherein said eyelet is provided on an upper side of the shank.

11. A method according to claim 1, wherein said two pins are expandible pins.

12. A method according to claim 1, wherein each of said two pins has an inner side formed by sectors, each of the sectors being formed by a cylindrical surface portion with a free front part to provide a number of front parts, the front parts of said sectors defining a substantially circular shape with a diameter varying between a maximum value (4*a*) and a minimum value (4*c*), and a difference between the maximum value and said minimum value is comprised between 10% and 30% of the maximum value (4*a*): $0.30*(4a) \geq \Delta = (4a-4c) \geq 0.10*(4a)$.

13. A method according to claim 1, wherein said ascending or descending portion is a vertical portion of said predefined path.

14. A method according to claim 1, wherein said two pins are extracted, by means of the movable arms of the bridge crane, from an exhausted parent reel that is transferred to an unloading station for exhausted reels.

15. A method according to claim 1, wherein transporting the parent reel along the predefined path ends in correspondence of the unwinder equipped with an unwinding means positioned and acting under a support adapted to support the parent reel, the unwinder being free from superstructures.

16. A method according to claim 1, wherein said platform receives exhausted reels removed from the unwinder.

17. A method for handling parent reels in paper converting plants, the method comprising the following steps:

providing at least one platform with a base configured to support a parent reel in a waiting station and at least one unwinder configured to receive said parent reel in an unwinding station where said parent reel is unwound;

positioning said parent reel on said platform at said waiting station;

providing a bridge crane comprising movable arms;

moving a plurality of pins relative to said parent reel via said movable arms such that one of said plurality of pins is inserted in one base of said parent reel and another one of said pins is inserted in another base of said parent reel via said movable arms; and transporting said parent reel along a predefined path from said platform to said at least one unwinder via said bridge crane after inserting said plurality of pins in said parent reel, wherein one of said movable arms is in contact with said one of said plurality of pins and another one of said movable arms in contact with said another one of said plurality of pins when said parent reel is transported along at least a portion of said predefined path via said bridge crane, said transporting said parent reel along said predefined path comprising at least one ascending or descending portion with said two pins inserted into said parent reel, wherein each of said movable arms is moved to a position located at a spaced location from said two pins after said parent reel is transported along said predefined path.

18. A method for handling parent reels in paper converting plants, the method comprising the following steps:

providing at least one platform with a base configured to support a parent reel in a waiting station and at least one unwinder configured to receive said parent reel in an unwinding station where said parent reel is unwound;

positioning said parent reel on said platform at said waiting station;

providing a bridge crane comprising a plurality of movable arms;

moving a plurality of pins relative to said parent reel via said movable arms such that one of said plurality of pins is inserted in one base of said parent reel and another one of said pins is inserted in another base of said parent reel via said movable arms;

transporting said parent reel along said predefined path via said bridge crane after inserting said pins in said parent reel, wherein said one of said movable arms is in contact with said one of said plurality of pins and said another one of said movable arms in contact with said another one of said plurality of pins when said parent reel is transported along at least a portion of said predefined path via said bridge crane, said transporting said parent reel along said predefined path comprising at least one ascending or descending portion with said two pins inserted into said parent reel; and moving said movable arms after transporting said parent reel along said predefined path such said one of said movable arms is located at a spaced location from said one of said plurality of pins and said another one of said movable arms is located at a spaced location from said another one of said plurality of pins.

* * * * *